US006292649B1

(12) United States Patent
Toyama et al.

(10) Patent No.: US 6,292,649 B1
(45) Date of Patent: Sep. 18, 2001

(54) CONTINUOUS MEDIUM PRINTING APPARATUS

(75) Inventors: Toshimasa Toyama, Kawasaki; Kiyoshi Chinzei, Kato-gun; Yasuharu Takeuchi; Katsuya Shimatsu, both of Kawasaki; Makoto Maki, Kato-gun; Naoto Hirao, Kawasaki, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/659,594

(22) Filed: Sep. 11, 2000

Related U.S. Application Data

(62) Division of application No. 09/494,143, filed on Jan. 28, 2000, now Pat. No. 6,175,716.

(30) Foreign Application Priority Data

Feb. 10, 1999 (JP) ..... 11-033124

(51) Int. Cl.[7] ..... L03G 15/00

(52) U.S. Cl. ..... 399/384; 346/136; 347/153; 400/613.2

(58) Field of Search ..... 399/384; 276/91; 346/136; 347/153, 262; 400/583, 613.1, 613.2

(56) References Cited

U.S. PATENT DOCUMENTS 4,330,194 5/1982 Murakami .
5,065,196 11/1991 Kanaya et al. .
5,701,565 12/1997 Morgan .
6,137,988 * 10/2000 Yonemochi ..... 399/384

FOREIGN PATENT DOCUMENTS 55-81363 6/1980 (JP) .
2-231170 9/1990 (JP) .
5-16475 1/1993 (JP) .

* cited by examiner

*Primary Examiner*—Joan Pendegrass
(74) *Attorney, Agent, or Firm*—Armstrong, Westerman, Hattori, McLeland & Naughton

(57) ABSTRACT

The invention provides a continuous medium printing apparatus which can exert a transporting force to act upon a continuous medium without additional provision of a new tractor mechanism or some other transport mechanism. In the continuous medium printing apparatus, upon automatic loading of a continuous medium, a control section controls a charging operation of a charging section so that a leading end portion of the continuous medium may be electrostatically attracted to an image forming drum. The image forming drum to which the continuous medium is attracted is rotated in a printing transporting direction to exert a transporting force to act upon the continuous medium to transport the continuous medium in the printing transporting direction. The present invention is applicable to an apparatus which prints on a continuous medium such as continuous recording paper (continuous paper), for example, by electrophotography.

21 Claims, 18 Drawing Sheets

FIG. 10

| TRANSFER CURRENT (mA) | | PAPER THICKNESS | | |
|---|---|---|---|---|
| | | 45 kg PAPER | 55 kg PAPER | 135 kg PAPER |
| PAPER LENGTH | 9-inch PAPER | 0.4 | 0.6 | 0.8 |
| | 15-inch PAPER | 0.6 | 0.8 | 1.0 |
| | 18-inch PAPER | 0.8 | 1.0 | 1.2 |

FIG. 11

| SEPARATION VOLTAGE (P-P, DC) (kV,V) | | PAPER THICKNESS | | |
|---|---|---|---|---|
| | | 45 kg PAPER | 55 kg PAPER | 135 kg PAPER |
| PAPER LENGTH | 9-inch PAPER | 10, -300 | 10, -300 | 10, -400 |
| | 15-inch PAPER | 10, -300 | 10, -400 | 10, -500 |
| | 18-inch PAPER | 10, -400 | 10, -500 | 11, -500 |

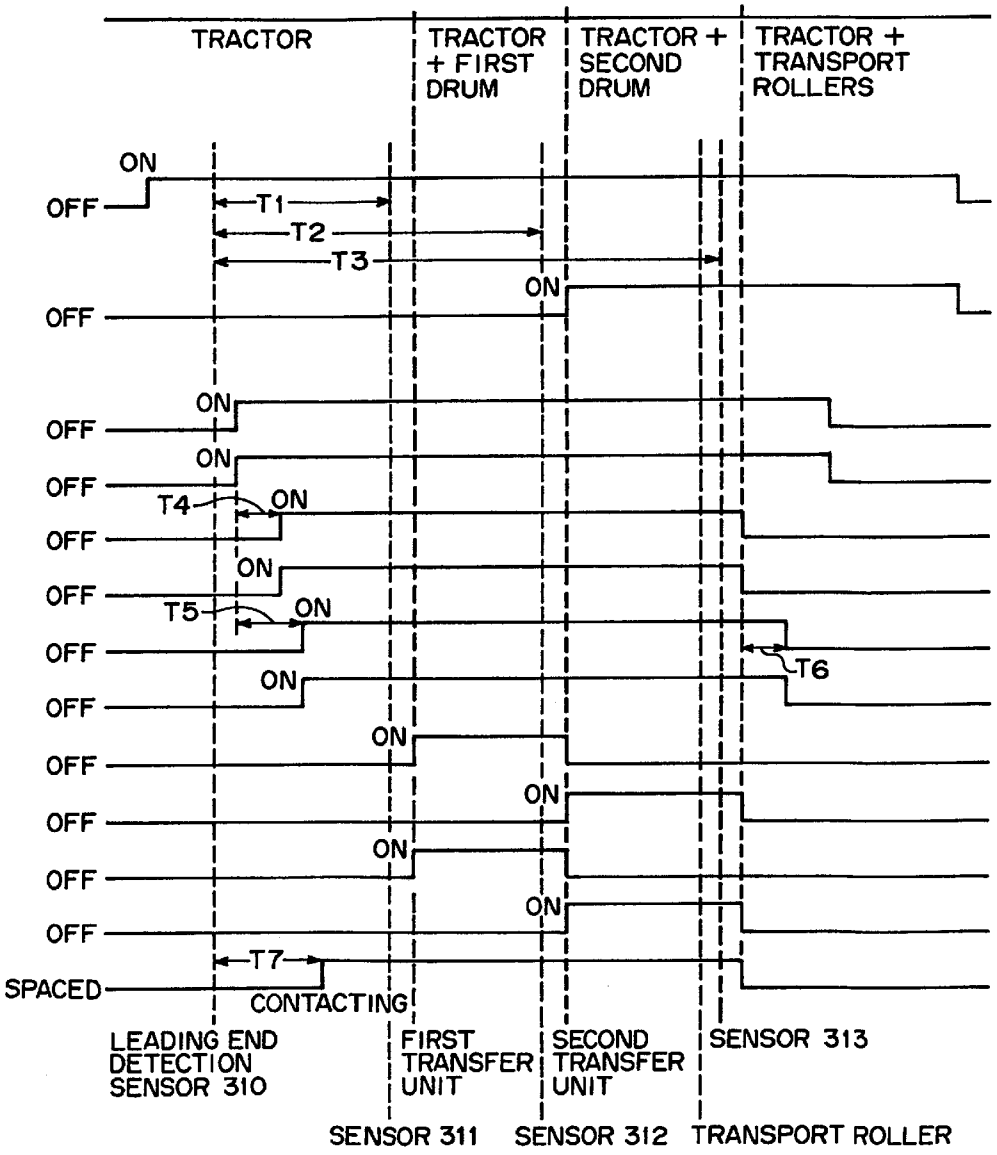

FIG.12A TRANSPORTING FORCE

FIG.12B TRACTOR MECHANISM (PAPER TRANSPORT)

FIG.12C TRANSPORT ROLLER

FIG.12D ROTATION OF FIRST DRUM

FIG.12E ROTATION OF SECOND DRUM

FIG.12F FIRST PRECHARGER

FIG.12G SECOND PRECHARGER

FIG.12H FIRST DEVELOPMENT BIAS

FIG.12I SECOND DEVELOPMENT BIAS

FIG.12J FIRST TRANSFER CHARGER / FIRST TRANSFER GUIDE ROLLER

FIG.12K SECOND TRANSFER CHARGER / SECOND TRANSFER GUIDE ROLLER

FIG.12L FIRST SEPARATION CHARGER

FIG.12M SECOND SEPARATION CHARGER

FIG.12N FIRST / SECOND SEPARATION WEDGE

CONTINUOUS MEDIUM PRINTING APPARATUS

This application is a division of prior application Ser. No. 09/494,143 filed Jan. 28, 2000 now U.S. Pat. No. 6,175,716.

BACKGROUND OF THE INVENTION

1. Field of the Invention

This invention relates to a continuous medium printing apparatus which prints on a continuous medium such as continuous recording paper (continuous paper), for example, by electrophotography.

2. Description of the Related Art

Generally, a printing process station for a continuous paper printer (continuous medium printing apparatus) which adopts electrophotography includes a photosensitive drum (image forming drum) capable of forming a print image on continuous paper (which may be hereinafter referred to merely as paper) while rotating in a printing transporting direction of the continuous paper, and several apparatus (for example, a precharger, an exposure unit, a development unit, a transfer charger, an AC discharger, a cleaning unit, an LED discharger and so forth) disposed around the photosensitive drum for performing various processes such as charging, discharging, exposure, development and cleaning.

In order to load such continuous paper as described above into the continuous paper printer, an operator will first set a leading end of the continuous paper to a suitable position on a paper transport path and then render an automatic loading mechanism (automatic paper setting mechanism) operative. Consequently, the continuous paper is automatically loaded into the continuous paper printer and set to a printable state by the automatic loading mechanism.

Upon such loading, the automatic loading mechanism makes use of a transporting force of paper transport tractors provided forwardly and backwardly of a transfer region (printing process station mentioned above) to transport the continuous paper to pass through the transfer region and then through a fixing station to a stacker under the guidance of transfer guides and other guide members. The continuous paper has feed holes formed successively in an equally separated relationship from each other along the opposite sides thereof for engaging with the paper transport tractors of the continuous paper printer so that the continuous paper may be transported by the paper transport tractors.

Upon printing, the photosensitive drum is rotated in a predetermined direction and the surface thereof is charged uniformly by the precharger. Then, the surface of the photosensitive drum is exposed to light by the exposure unit to form an electrostatic latent image of a pattern corresponding to printing information from a host apparatus on the surface of the photosensitive drum. The electrostatic latent image is developed into a toner image by the development unit.

Meanwhile, the continuous paper is transported from a hopper to a transfer position under the guidance of various guides by a paper transport mechanism such as a tractor. At the transfer position, the toner image on the photosensitive drum is transferred to the continuous paper by the transfer charger disposed in an opposing relationship to the photosensitive drum across the continuous paper.

Thereafter, the toner image transferred to the continuous paper is fixed to the continuous paper by heat, a pressure or light applied thereto by the fixing station, and is then sent out to the stacker or else is subject to post-processing by a post-processing apparatus such as a cutter apparatus.

The surface of the photosensitive drum after the transfer step has toner powder remaining thereon without having been transferred to the continuous paper, and the remaining toner powder must be removed from the photosensitive drum. Therefore, the charge of the remaining toner powder is removed by the AC discharger, and then the remaining toner powder is removed mechanically from the surface of the photosensitive drum by the cleaning unit. Usually, a cleaning blade or a cleaning brush is frequently used as the mechanical removing means.

After the remaining toner powder is removed from the photosensitive drum in this manner, optical discharge is performed by the LED discharge in order to return the potential on the surface of the photosensitive drum to its initial state (0 V). Then, in preparation for the next transfer step, the surface of the photosensitive drum is charged uniformly by the precharger again.

In a printer which prints on continuous paper as described above, the continuous paper after printed is either taken up onto and accommodated as a roll, or folded and accommodated in a stacker.

Continuous paper used for the latter case has portions called perforations formed at fixed intervals therein so that the continuous paper may be folded at the perforations thereof. In this instance, in order to fold and accommodate the continuous paper with certainty into the stacker, when the continuous paper is set to the continuous paper printer, a fold position (perforation position) of the continuous paper must be arranged at a correct position in accordance with the folding length of the continuous paper, that is, in accordance with the distance between adjacent perforations. It is to be noted that, in the present specification, the term "perforation" is used to signify a large number of very small holes perforated in a continuous printing medium in a row or line perpendicular to the longitudinal direction of the continuous printing medium (in which the continuous printing medium is transported) in order to facilitate folding of the continuous printing medium along the line(refer to perforation 1*c* in any of FIGS. 13 to 16 and 22).

In order to perform such positioning of a perforation, a continuous paper setting section (continuous medium mounting section) of a continuous paper printer is conventionally constructed in such a manner as shown in FIG. 22.

In particular, a tractor mechanism (paper transport tractor) 73 for a continuous paper printer is constructed such that continuous paper 1 is set into it while it is held by a pair of paper holders 731 and 732 from the opposite sides thereof. Each of the paper holders 731 and 732 has graduations (stickers) 351 provided thereon each of which indicates a position at which the continuous paper 1 is to be set as an arrangement position for a perforation 1*c*. The graduations 351 of the two paper holders 731 and 732 indicate the same positions as each other.

Each of the graduations 351 of the paper holder 731 has numerical value information (stickers) 361' provided therefor which indicates the distances (paper fold lengths) between adjacent perforations 1*c* of different continuous papers to be set to the positions of the graduations 351. It is to be noted that, in FIG. 22, each of the particular numerical values "9", "10", . . . , "14" provided for the graduations :351 represents the distance (unit: inch) between adjacent perforations 1*c* which is different depending upon the type of the continuous paper 1.

When an operator tries to set the continuous paper 1 to the printer, the operator recognizes the distance (paper fold length) between perforations 1*c* of the continuous paper 1 and sets the continuous paper 1 so that the position of one of the graduations 351 to which the numerical value information 361' corresponding to the distance is provided and the position of a perforation 1*c* may coincide with each other. In particular, in order to set the continuous paper 1 which has perforations 1*c* the distance between which is, for example, 10 inches, the position of a perforation 1*c* of the continuous paper 1 is brought into coincident with the position of that one of the graduations 351 to which "10" is added as the numerical value information 361'.

Conventionally, as a method of printing on both faces of continuous paper, a method is available wherein two such continuous paper printers (single-sided printers) as described above are connected to each other such that the front face (or back face) of the continuous paper is printed by the first one of the continuous paper printers first and then, after the continuous paper is twisted so as to be revered, the back face (or front face) of the continuous paper is printed by the second continuous paper printer.

However, since the method described above requires two continuous paper printers and further requires a mechanism for reversing continuous paper between the continuous paper printers, it has a subject to be solved in that not only the printing velocity is reduced, but also a very large installation area is required for the apparatus, and so forth.

Therefore, in recent years, a double-sided printer has been proposed wherein a pair of such printing process sections as described above are provided on the opposite sides of a paper transport path (continuous paper). According to a double-sided printer of the type just described, printing on the front face of continuous paper is performed by one of the printing process sections and printing on the back face of the continuous paper is performed by the other printing process section in the single apparatus. Accordingly, since the double-sided printer does not require reversal of continuous paper and does not require connection of two apparatus to each other, the problems regarding the printing velocity, installation area and so forth are eliminated.

However, the double-sided printer described above presents a new subject to be solved in regard to an automatic loading mechanism for automatically loading continuous paper.

In particular, in the double-sided printer described above, since the printing process sections (photosensitive drums and so forth) are present on the opposite sides of the paper transport path (continuous paper), it is very difficult in regard to the apparatus layout to dispose a tractor mechanism which exerts a transporting force to act upon the continuous paper between the printing process sections. Further, even if the tractor mechanism is disposed between the printing process sections, this increases the size of the apparatus.

Upon automatic mounting (automatic loading) of continuous paper, it is difficult to transport the continuous paper only by transporting force of the tractor mechanism on the upstream side with respect to the printing process sections so that a leading end portion of the continuous paper may pass between the two printing process sections and reach the tractor mechanism on the downstream side with certainty. Therefore, it is desired that, where a plurality of printing process sections are provided in a single printer, continuous paper can be transported to allow automatic loading thereof with certainty without additional provision of a new tractor mechanism or some other transport mechanism between the printing process sections.

Meanwhile, a single-sided printer which includes only one printing process section does not particularly suffer from a problem if the transporting direction of continuous paper is a horizontal direction. However, if the transporting direction of the continuous paper in the printing process section includes a vertical direction, then a leading end portion of the continuous paper may possibly be warped downwardly by the gravity, resulting in failure to effect automatic loading of the continuous paper. Therefore, also with regard to a single-sided printer, it is desired to allow continuous paper to be transported without additionally providing a new tractor mechanism or some other transporting mechanism so that automatic loading of the continuous paper can be performed with certainty irrespective of the transporting direction of the continuous paper.

On the other hand, when a continuous paper printer of the type wherein continuous paper after printed is folded and accommodated into a stacker performs automatic loading of continuous paper, as described hereinabove with reference to FIG. 22, an operator refers to the numerical value information 361' and the graduations 351 to set the continuous paper 1 to a position corresponding to the distance between perforations 1*c* of the continuous paper 1.

In this instance, where various types of continuous paper which are different in fold length (distance between perforations) are settable to the continuous paper printer, a large number of graduations 351 and numerical value information 361' must be provided, and depending upon a case, the indications of the graduations 351 and/or the numerical value information 361' are complicated such that the graduations 351 or the numerical values of the numerical value information 361' are indicated closely to each other or the graduations 351 for a plurality of types of continuous paper of different sizes are indicated in an overlapping relationship with each other (where paper sizes have a common multiple).

Further, the double-sided printer described above is used switchably in a mode wherein the two printing process sections are used to perform double-sided printing and another mode wherein only one of the printing process sections is used to perform single-sided printing. In this instance, since the transport path length of the continuous paper 1 is somewhat different whether the double-sided print is used in the double-sided printing mode and the single-sided printing mode, even for the continuous paper 1 of the same fold length (distance between perforations), the continuous paper setting position must be varied between the double-sided printing mode and the single-sided printing mode. Accordingly, where a double-sided printer is provided with such graduations 351 and numerical value information 361' as shown in FIG. 22, the graduations 351 and the numerical value information 361' must be provided for each of the different types of the continuous paper 1 and for each printing mode. This further complicates the indications of the graduations 351 and numerical value information 361'.

Further, upon setting of the continuous paper 1, conventionally an operator discriminates and determines one of the graduations 351 to which a perforation 1*c* of the continuous paper 1 should be set based on the printing mode and the fold length (distance between perforations). Therefore, in a printer of the type which has a plurality of printing modes and to which various kinds of continuous papers having different fold lengths (distances between perforations) can be set, an operator is liable to make an error in setting the continuous paper 1, and such erroneous setting gives rise to such troubles as paper jamming, wrong position printing, irregular paper stacking in a stacker and so forth.

SUMMARY OF THE INVENTION

It is an object of the present invention to provide a continuous medium printing apparatus which can exert a transporting force to act upon a continuous medium without additional provision of a new tractor mechanism or some other transport mechanism to allow automatic loading of the continuous medium with certainty without complicating the apparatus structure.

It is another object of the present invention to provide a continuous medium printing apparatus which allows, also where the apparatus has a plurality of printing modes and allows use of a large number of types of continuous media thereon, the arrangement position of a perforation, which corresponds to the current printing mode of the apparatus and the type of the continuous medium used, upon loading of the continuous medium to be recognized accurately without depending upon discrimination of an operator thereby to prevent occurrence of a trouble, which otherwise arises from erroneous mounting of the continuous medium, with certainty.

In order to attain the objects described above, according to an aspect of the present invention, there is provided a continuous medium printing apparatus for printing on a continuous medium, comprising an image forming drum for being rotatable in a printing transporting direction of the continuous medium and forming a print image on the continuous medium, a charging section for charging at least one of the continuous medium and the image forming drum in order to form a print image on the continuous medium, and a control section for controlling the charging operation of the charging section, the control section controlling, upon automatic loading of the continuous medium into the continuous medium printing apparatus, the charging operation of the charging section so that a leading end portion of the continuous medium may be electrostatically attracted to the image forming drum, whereafter the image forming drum rotates in the printing transporting direction with the continuous medium attracted thereto to exert a transporting force to act upon the continuous medium to transport the continuous medium in the printing transporting direction.

According to another aspect of the present invention, there is provided a continuous medium printing apparatus for printing on a continuous medium, comprising a plurality of image forming drums disposed along a transport path of the continuous medium for rotating in a printing transporting direction of the continuous medium and forming a print image on the continuous medium, a plurality of charging sections provided individually for the image forming drums for charging at least one of the continuous medium and the image forming drums in order to form a print image on the continuous medium, and a control section for controlling the charging operations of the plurality of charging sections, the control section controlling, upon automatic loading of the continuous medium into the continuous medium printing apparatus, the charging operations of the charging sections so that a leading end portion of the continuous medium may be electrostatically attracted successively to the image forming drums in order beginning with one of the image forming drums which is positioned on the most upstream side along the transport path, whereafter the plurality of image forming drums rotate in the printing transporting direction successively in order beginning with one of the image forming drums which is positioned on the most upstream side along the transport path with the continuous medium attracted thereto to exert a transporting force to act upon the continuous medium to transport the continuous medium in the printing transporting direction.

In the continuous medium printing apparatus, a precharger for charging, upon printing on the continuous medium, each of the plurality of image forming drums in order to form a print image on the image forming drum may be used for the charging section or the plurality of charging sections, or alternatively, a transfer charger for charging, upon printing on the continuous medium, the continuous medium in order to transfer a print image on each of the plurality of image forming drums to the continuous medium may be used for the charging section or the plurality of charging sections.

The control section may control the charging operation of each of the plurality of charging sections so that, upon automatic loading of the continuous medium into the continuous medium printing apparatus, a predetermined region of the leading end portion of the continuous medium from a leading end is left as a non-charged region and the continuous medium is charged in another region thereof following the predetermined non-charged region.

The continuous medium printing apparatus may further comprise a medium separating section for separating, as the continuous medium is sent out in the printing transporting direction with the leading end portion of the continuous medium attracted to each of the plurality of image forming drum, the leading end portion of the continuous medium attracted to the image forming drum away from the image forming drum.

In this instance, a separation charger for charging, upon printing on the continuous medium, the continuous medium so as to be separated away from the image forming drum may be used for the medium separating section. Further, a separation voltage upon automatic loading of the continuous medium by the separation charger may be set higher than a separation voltage used upon printing on the continuous medium. Furthermore, the charging operation by the separation charger may be ended after the charging operation by each of the plurality of charging sections upon automatic loading of the continuous medium is ended.

The medium separating section may include a separation wedge disposed in the proximity of the image forming drum for separating the continuous medium sent out in the printing transporting direction from the image forming drum. In this instance, the control section may control the charging operation of the charging section so that the leading end portion of the continuous medium may be electrostatically attracted to the image forming drum after the leading end of the continuous medium passes the position of the separation wedge. Alternatively, the continuous medium printing apparatus may be constructed such that it further comprises a separation wedge contacting mechanism for moving the separation wedge into and out of contact with the image forming drum, and, upon charging operation by the charging section upon automatic loading of the continuous medium, the separation wedge contacting mechanism moves the separation wedge into contact with the image forming drum, but after completion of the charging operation by the charging section, the separation wedge contacting mechanism moves the separation wedge out of contact with the image forming drum.

The control section may control each of the plurality of charging sections to vary the electrostatic attracting force between the continuous medium and the image forming drum in accordance with a printing condition. Where a precharger is used for the charging sections, the control section may control each of the prechargers to vary the charging potential of a corresponding one of the image forming drums in accordance with a printing condition. Alternatively where a transfer charger is used for the charging sections, the control section may control each of the transfer chargers to vary the transfer current in accordance with a printing condition. Further, where a separation charger is used for the medium separating sections, the separation voltage by the separation charger upon automatic loading of the continuous medium may be varied in accordance with a printing condition.

Here, the printing condition includes a medium condition including a characteristic of the continuous medium or an apparatus installation environment condition. The medium condition includes, for example, a thickness of the continuous medium or a width of the continuous medium, and the apparatus installation environment condition includes, for example, a temperature and/or humidity.

Each of the image forming drums may be driven to rotate such that the circumferential velocity of the image forming drum upon automatic loading of the continuous medium is higher than a transporting velocity of the continuous medium.

Where the continuous medium printing apparatus comprises a plurality of image forming drums and a plurality of charging sections, the transporting force by one of the image forming drums in a preceding stage may be cancelled at a point of time when the leading end portion of the continuous medium reaches another one of the image forming drums in a following stage and is electrostatically attracted to the image forming drum in the following stage. In this instance, for the method of cancelling the transporting force, the following techniques ① to ④ may be used.

① Where a precharger for charging each of the image forming drums in order to form a print image on the image forming drum upon printing on the continuous medium is used for the charging sections, the control section controls each of the prechargers to stop the charging operation for the image forming drum to cancel the transporting force.

② Where a transfer charger for charging the continuous medium in order to transfer a print image on the image forming drum to the continuous medium upon printing on the continuous medium is used for the charging sections, the control section controls each of the transfer chargers to stop the charging operation for the continuous medium to cancel the transporting force.

③ Where a transfer charger for charging the continuous medium in order to transfer a print image on the image forming drum to the continuous medium upon printing on the continuous medium is used for the charging sections and the continuous medium printing apparatus further comprises a transfer charger contacting mechanism for moving each of the transfer chargers into and out of contact with the continuous medium, the transfer charger contacting mechanism cancels the transporting force by moving the transfer charger out of contact with the continuous medium.

④ Where the continuous medium printing apparatus further comprises a transfer guide roller for cooperating with each of the image forming drums to hold the continuous medium therebetween and rotating to guide the continuous medium in the printing transporting direction and a roller contacting mechanism for moving the transfer guide roller into and out of contact with the image forming drum, the transporting force is cancelled when each of the transfer charger contacting mechanisms moves the transfer guide roller out of contact with the image forming drum.

In this instance, the transporting force may be cancelled at any of such timings as given in ⑤ and ⑥ below.

⑤ Where the continuous medium printing apparatus further comprises a timer which starts a time counting operation at a point of time when the leading end portion of the continuous medium passes the position of the image forming drum in the preceding stage, the transporting force by the image forming drum in the preceding stage is cancelled at a point of time when the timer measures a predetermined time required until the leading end portion of the continuous medium is attracted by the image forming drum in the following stage after the leading end portion of the continuous medium passes the position of the image forming drum in the preceding stage.

⑥ Where the continuous medium printing apparatus further comprises a sensor for detecting that the leading end portion of the continuous medium reaches the attracting position of the image forming drum in the following stage, the transporting force by the image forming drum in the preceding stage is cancelled at a point of time when the sensor detects that the leading end portion of the continuous medium reaches the attracting position of the image forming drum in the following stage.

The continuous medium printing apparatus may further comprise a transport guide provided along the transport path of the continuous medium between adjacent ones of the plurality of image forming drums for guiding the continuous medium.

The continuous medium printing apparatus may be constructed such that it further comprises medium transport means provided on the downstream side with respect to the image forming drums for transporting the continuous medium, and each of the image forming drums exerts the transporting force to act upon the continuous medium to transport the continuous medium in the printing transporting direction until the leading end portion of the continuous medium reaches the medium transport means.

The printing transporting direction of the continuous medium which may be transported by the image forming drums is an upward direction. One of the plurality of image forming drums which is in a following stage may be disposed above another one of the plurality of image forming drums which is in a preceding stage.

According to a further aspect of the present invention, there is provided a continuous medium printing apparatus for printing on a continuous medium on which a plurality of folding perforations are formed in a separated relationship by a fixed distance from each other, comprising a continuous medium mounting section onto which the continuous medium is to be mounted when automatic loading of the continuous medium into the continuous medium printing apparatus is to be started, a perforation position indication section for indicating a position of the continuous medium mounting section at which the continuous medium is to be mounted as an arrangement position of any of the perforations, and a perforation position determination section for determining an arrangement position of any of the perforations to be indicated by the perforation position indication section in accordance with a printing condition for the continuous medium.

In the continuous medium printing apparatus, the perforation position indication section may include a plurality of graduations provided in the proximity of the continuous medium mounting section for directly indicating an arrangement position of any of the perforations and having identification information added thereto, and a display section for displaying the identification information of one of the graduations which corresponds to the arrangement position of any of the perforations determined by the perforation position determination section.

In this instance, a display unit of an operation panel of the continuous medium printing apparatus may be used as the display section. As an alternative, a seven-segment display unit provided in the proximity of the continuous medium mounting section may be used as the display section. As another alternative, a display unit of an operation panel provided for exclusive use for operating automatic loading of the continuous medium may used as the display section.

The continuous medium printing apparatus may be constructed such that the graduations are distributed on the continuous medium mounting section on the opposite sides in a widthwise direction of the continuous medium across the continuous medium, and the graduations on the opposite sides in the widthwise direction of the continuous medium indicate different arrangement positions for any of the perforations from each other.

In this instance, those of the graduations on one side indicate arrangement positions for any one of the perforations upon single-sided printing and those of the graduations on the other side may indicate arrangement positions for any of the perforations upon double-sided printing. Alternatively, the continuous medium printing apparatus may be constructed such that it further comprises a pair of light emitting elements provided on the opposite sides in the widthwise direction of the continuous medium for indicating whether an indication by one of those of the graduations on one of the opposite sides in the widthwise direction of the continuous medium or an indication by one of those of the graduations on the other of the opposite sides in the widthwise direction of the continuous medium is valid, and one of the light emitting elements which is on that side of one of the graduations which is determined to indicate an arrangement position of any of the perforations by the perforation position determination section is driven to be lit.

The continuous medium printing apparatus may be constructed such that the perforation position indication section includes a plurality of light emitting elements provided in the proximity of the continuous medium mounting section for indicating an arrangement position of any of the perforations, and one of the light emitting elements which is disposed at an arrangement position of one of the perforations determined by the perforation position determination section is driven to be lit.

In this instance, the continuous medium printing apparatus may be constructed such that the plurality of light emitting elements are distributed on the opposite sides in a widthwise direction of the continuous medium across the continuous medium on the continuous medium mounting section, and the light emitting elements on the opposite sides in the widthwise direction of the continuous medium indicate different arrangement positions for any of the perforations from each other. Further, those of the light emitting elements on one side indicate arrangement positions for any of the perforations upon single-sided printing and those of the light emitting elements on the other side may indicate arrangement positions for any of the perforations upon double-sided printing.

The continuous medium printing apparatus may be constructed such that the perforation position indication section includes a movable indication member provided in the proximity of the continuous medium mounting section for indicating an arrangement position of any of the perforations, and the movable indication member is driven to be positioned at an arrangement position of any of the perforations determined by the perforation position determination section. Further, the continuous medium printing apparatus may be constructed such that the movable indication members are provided on the opposite sides in a widthwise direction of the continuous medium across the continuous medium on the continuous medium mounting section, and the movable indication members on the opposite sides in the widthwise direction of the continuous medium indicate arrangement positions for any of the perforations which are different from each other.

In this instance, the continuous medium printing apparatus may be constructed such that one of the movable indication members on one side indicates an arrangement position of any of the perforations upon single-sided printing and the other of the movable indication members on the other side indicates an arrangement position of any of the perforations upon double-sided printing. Alternatively, the continuous medium printing apparatus may be constructed such that one of the movable indication members which is on one of the opposite sides in the widthwise direction of the continuous medium on which an indication is invalid is driven to be positioned at a position outside a predetermined range for indicating an arrangement position of any of the perforations.

The continuous medium printing apparatus may further comprise a printing condition inputting section for inputting the printing condition to the perforation position determination section. The printing condition may include information regarding the fixed distance between the perforations formed in the continuous medium or information regarding a printing operation for the continuous medium. In the latter case, the information regarding a printing operation may be printing mode information which indicates whether single-sided printing should be performed or double-side printing should be performed for the continuous medium.

With the continuous medium printing apparatus of the present invention described above, the following effects or advantages can be achieved.

[1] Since, upon automatic loading of the continuous medium into the continuous medium printing apparatus, the image forming drum or each of the image forming drums rotates with the continuous medium attracted thereto to transport the continuous medium in the printing transporting direction, the image forming drum which is originally provided so as to be used to perform printing can exert a transporting force to act upon the continuous medium to transport the continuous medium without additional provision of a new tractor mechanism or some other transport mechanism. Accordingly, also where a plurality of printing process sections are provided in a single apparatus and also where the transporting direction of the continuous medium includes an upward direction, automatic loading of the continuous medium can be achieved with certainty without complicating the structure of the apparatus.

[2] Since, upon automatic loading of the continuous medium, the predetermined region of the leading end portion of the continuous medium from the leading end is left as a non-charged region and the continuous medium is charged in another region thereof following the predetermined non-charged region, the leading end of the continuous medium can be separated away from the image forming drum readily, and the continuous medium can be transported with certainty toward the downstream side of the transport path without causing penetration of the leading end of the continuous medium into the separation wedge to cause jamming.

[3] Since the continuous medium sent out in the printing transport direction by any of the image forming drums can be separated away from the image forming drum by the medium separation section, the continuous medium can be transported with certainty toward the downstream side of the transport path.

[4] Where a separation wedge is used for the medium separating sections, since the continuous medium can be mechanically/compulsorily separated away from the image forming drum, the continuous medium can be transported with a higher degree of certainty to the downstream side of the transport path. In this instance, where the leading end portion of the continuous medium is electrostatically attracted to the image forming drum after the leading end of the continuous medium passes the position of the separation wedge, the predetermined region of the leading end portion of the continuous medium from the leading end can be set as a non-charged region, and the region following the non-charged region is charged. Consequently, as described above, the leading end of the continuous medium can be separated away from the image forming drum readily, and the continuous medium can be transported with certainty toward the downstream side of the transport path without causing penetration of the leading end of the continuous medium into the separation wedge to cause jamming.

[5] Since the charging sections (prechargers, transfer chargers) and the separation chargers (medium separating sections) are controlled in accordance with a printing condition such as a medium condition (the thickness or width of the continuous medium) or an apparatus installation environment condition (the temperature or humidity), the continuous medium can be attracted with certainty to the image forming drum or can be separated away from the image forming drum with certainty, and consequently, the continuous medium can be transported with certainty toward the downstream side of the transport path.

[6] Since, upon automatic loading of the continuous medium, each of the image forming drums is driven to rotate so that the circumferential velocity of the image forming drum may be higher than a transporting velocity of the continuous medium, a tension acts upon the continuous medium on the upstream side with respect to the image forming drum, and consequently, the continuous medium on the upstream side can be prevented from being warped with certainty and the continuous medium can be transported with certainty toward the downstream side of the transport path.

[7] Where a plurality of image forming drums and a plurality of charging sections are provided, since the transporting force by one of the image forming drums in a preceding stage is cancelled at a point of time when the leading end portion of the continuous medium reaches another one of the image forming drums in a following state and is electrostatically attracted by the image forming drum in the following stage, the continuous medium can be prevented from being acted upon simultaneously by restraints from the two image forming drums, and otherwise possible breakage of the continuous medium can be prevented with certainty.

[8] Where a transport guide for guiding the continuous medium is provided between a plurality of image forming drums, the continuous medium can be prevented from being bent between the image forming drums with certainty and can be transported with certainty to the image forming drum in the following state.

[9] Since the continuous medium is acted upon by a transporting force from one of the image forming drums until the leading end portion of the continuous medium reaches the medium transport means on the downstream side with respect to the image forming drum, the continuous medium can be automatically loaded with certainty and besides the continuous medium can be prevented from being acted upon by restraints simultaneously from the medium transport means and the image forming drum. Consequently, otherwise possible breakage of the continuous medium can be prevented with certainty.

[10] Since, upon automatic loading of a continuous medium, an arrangement position of any of the perforations conforming with a printing condition on the continuous medium (a mounting position on the continuous medium mounting section) and the arrangement position is indicated by the perforation position indication section, even where a large number of printing modes or a large number of types of continuous media are used, upon loading of a continuous medium, the arrangement position of a perforation suitable for the printing mode or the type of the continuous medium can be recognized accurately by an operator without depending upon discrimination of the operator. Consequently, occurrence of a trouble arising from an error in mounting of the continuous medium can be prevented with certainty.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 10 is a view illustrating an example of a setting table for transfer currents corresponding to different medium conditions (paper thickness and paper length) in the continuous medium printing apparatus of FIG. 1;

FIG. 11 is a view illustrating an example of a setting table for separation voltages corresponding to different medium conditions (paper thickness and paper length) in the continuous medium printing apparatus of FIG. 1;

FIGS. 12A to 12N are time charts illustrating details of an automatic loading procedure for a continuous medium by the continuous medium printing apparatus of FIG. 1;

DESCRIPTION OF THE PREFERRED EMBODIMENT

A continuous medium printing apparatus (which may be hereinafter referred to as continuous paper printer or merely as printer) according to an embodiment of the present invention is connected to a host apparatus such as a host computer and is operable, in response to a printing instruction from the host apparatus, to transport a continuous medium (which may be hereinafter referred to as continuous paper or merely as paper) such as continuous recording paper which is an object of printing of the continuous medium printing apparatus and print on the opposite faces of the continuous medium by electrophotography.

First, a construction of the continuous paper printer of the present embodiment is described with reference to FIGS. 1 to 6A and 6B.

Figure 5:
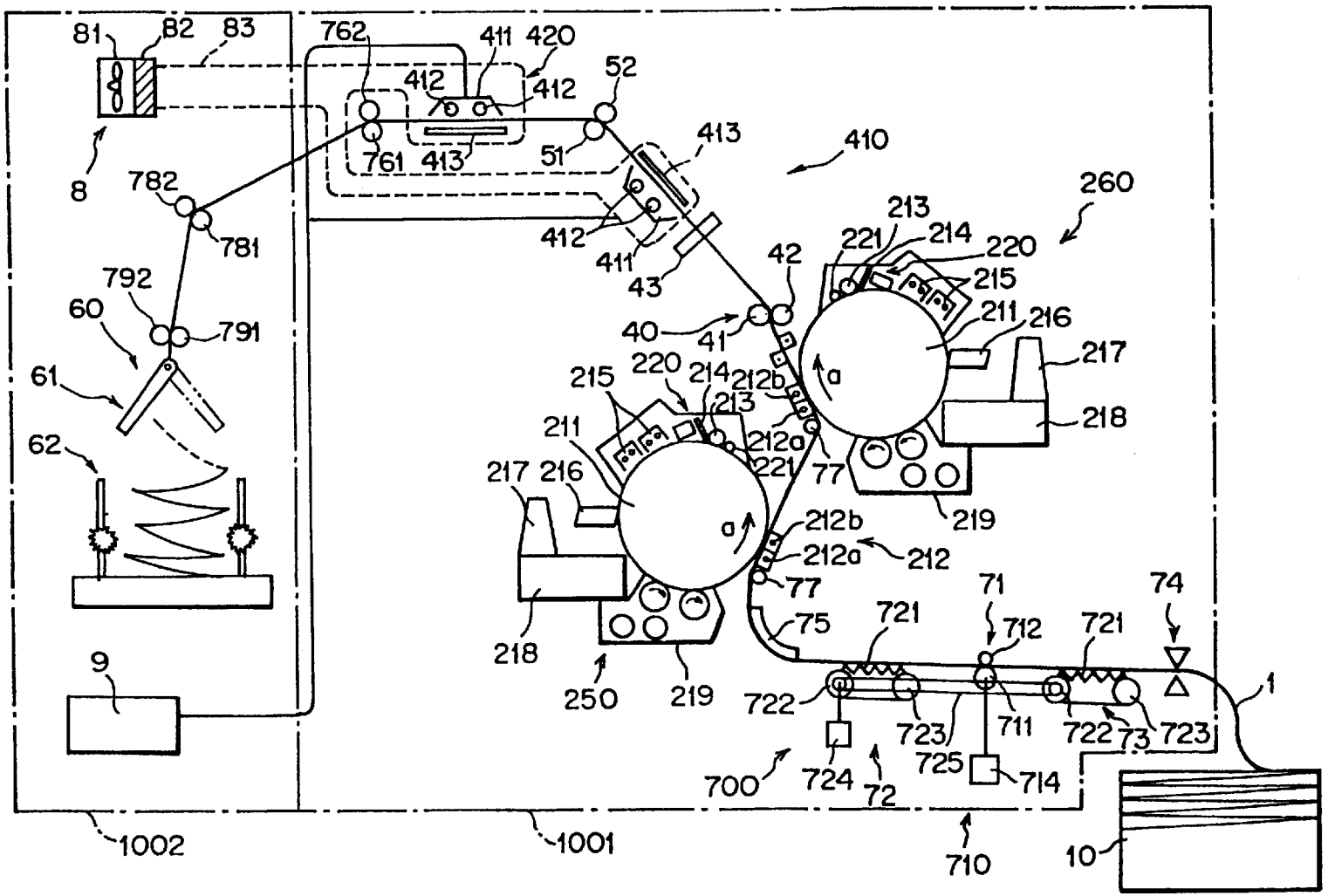
FIG. 5 is a side elevational view schematically showing a general construction of the continuous medium printing apparatus shown in FIG. 1.

The continuous paper printer of the present embodiment prints on the opposite faces of continuous paper 1 as seen in FIG. 5 and includes a paper hopper 10, a transport system 700, a first transfer process unit (first image forming process unit) 250, a second transfer process unit (second image forming process unit) 260, a first fixing unit 410, a second fixing unit 420, a stacker 60, a blower 8, a mechanism control section 100 (refer to FIG. 7) and a flash fixing unit power supply 9.

In the continuous paper printer of the present embodiment, in order to allow the continuous paper 1 to be folded and stacked into the stacker 60 after it is printed, the continuous paper 1 has perforations 1*c* formed in a predetermined separated relationship from each other therein (refer to FIGS. 13 to 16). Further, the continuous paper 1 has feed holes formed in an equally separated relationship from each other along the opposite side portions thereof for engaging with feed pins of tractor belts 721 of a pair of tractor mechanisms (paper transport tractors) 72 and 73 to allow transportation of the continuous paper 1.

The paper hopper 10 holds the continuous paper 1, which has not been printed as yet, in a folded state and successively supplies the continuous paper 1. An operator will place the non-printed continuous paper 1 into the paper hopper 10 before printing is started.

The stacker 60 stacks the continuous paper 1, which has been printed already and transported thereto by the transport system 700, cumulatively in a folded state, and includes a swing guide 61 and a stacking section 62. In particular, in the stacker 60, the swing guide 61 is driven to be rocked to guide the printed continuous paper 1 so as to distribute the continuous paper 1 alternately leftwardly and rightwardly in FIG. 5 in accordance with the distance between the perforations 1*c* so that the continuous paper 1 may be stacked into the stacking section 62 while it is folded back successively at the positions of the perforations 1*c*.

The first transfer process unit 250 transfers a toner image to the rear face of the continuous paper 1 by electrophotography under the control of the mechanism control section 100 which will be hereinafter described, and includes a photosensitive drum (image forming drum) 211, a transfer unit 212, an exposure LED unit (exposure section) 216, a precharger 215, a cleaning unit 220 and a development unit 219 with a toner hopper. The first transfer process unit 250 further includes various parts not shown such as an AC discharger and an LED discharger.

Upon printing, the photosensitive drum 211 rotates in a direction indicated by an arrow mark a while it contacts with the continuous paper 1. During rotation of the photosensitive drum 211, a toner image is formed on an outer circumferential face of the photosensitive drum 211 and transferred to the continuous paper 1.

The cleaning unit 220 which is a cleaner unit for collecting waste toner powder (remaining toner powder) and so forth on the surface of the photosensitive drum 211 is disposed adjacent the outer periphery of and above the photosensitive drum 211.

The cleaning unit 220 includes a constant pressure blade 214, a cleaning brush 213 and a waste toner screw 221 as shown in FIG. 5.

The constant pressure blade 214 is held in contact with the surface of the photosensitive drum 211 at a predetermined angle over the entire range of the photosensitive drum 211 in its axial direction. The photosensitive drum 211 rotates in one direction (direction indicated by an arrow mark a in FIG. 5) while it remains in contact with the constant pressure blade 214 so that remaining toner powder sticking to the surface of the photosensitive drum 211 may be exfoliated from the surface of the photosensitive drum 211 at the location where the photosensitive drum 211 contacts with the constant pressure blade 214.

The cleaning brush 213 is disposed over the entire range of the photosensitive drum 211 in its axial direction such that it contacts with the photosensitive drum 211 on the upstream side with respect to the constant pressure blade 214, and is driven to rotate in a direction opposing to the direction of rotation of the photosensitive drum 211 (the direction of the arrow mark a) while it is held in contact with the surface of the photosensitive drum 211. Consequently, the cleaning brush 213 functions to move remaining toner powder exfoliated from the surface of the photosensitive drum 211 by the constant pressure blade 214 toward the waste toner screw 221.

A scraping off plate (not shown) for scraping remaining toner powder off the cleaning brush 213 is provided fixedly on the upstream side with respect to the cleaning brush 213 along the outer periphery of the photosensitive drum 211 and extends over the entire extent of the photosensitive drum 211 in its axial directly in such a manner that it penetrates into the cleaning brush 213. Below the scraping off plate, the waste toner screw 221 for discharging remaining toner powder (waste toner powder) scraped off the cleaning brush 213 is disposed in parallel to the photosensitive drum 211.

The waste toner screw 221 is driven to rotate in a predetermined direction by a drive motor not shown.

Adjacent one end (waste toner powder discharging side end) of the waste toner screw 221, a toner cartridge 217 used up already is disposed as a waste toner collector for recovering waste toner powder sent out by the waste toner screw 221. In short, waste toner powder which has been transported by rotation of the waste toner screw 221 drops into and is recovered by the waste toner collector.

It is to be noted that, in order to prevent remaining toner powder from dropping onto the photosensitive drum 211 before it is recovered into the toner collector after it is exfoliated from the photosensitive drum 211, the cleaning unit 220 described above is surrounded by a cover not shown.

A plurality of (two in the present embodiment) prechargers (charging sections) 215 are disposed at positions on the downstream side with respect to the cleaning unit 220 along the outer periphery of the photosensitive drum 211 so that the surface of the photosensitive drum 211 may be charged uniformly by the prechargers 215.

The exposure LED unit 216 is disposed at a position on the downstream side with respect to the prechargers 215 along the outer periphery of the photosensitive drum 211. The exposure LED unit 216 is formed from an LED head or the like which irradiates an optical image corresponding to an image to be printed to form an electrostatic latent image on the surface of the photosensitive drum 211, and is included in an optical unit for exposure.

The development unit 219 with a toner hopper for developing an electrostatic latent image formed on the photosensitive drum 211 by the exposure LED unit 216 to form a toner image is disposed at a position on the downstream side with respect to the exposure LED unit 216 along the outer periphery of the photosensitive drum 211. A toner hopper 218 for supplying developing toner powder into the development unit 219 is mounted on the development unit 219 with a toner hopper. Further, a toner cartridge 217 for supplying developing toner powder to the toner hopper 218 is removably mounted on the toner cartridge 217.

The photosensitive drum 211 is contacted with the continuous paper 1 on the downstream side of the development unit 219 with a toner hopper along the outer periphery of the photosensitive drum 211 so that a toner image on the photosensitive drum 211 is transferred to the continuous paper 1 by the transfer unit 212.

The transfer unit 212 includes a transfer charger 212*a* and a separation charger 212*b* and is disposed at a position opposing to the photosensitive drum 211 across the continuous paper 1.

The transfer charger (charging section) 212*a* generates corona discharge with a potential of a polarity reverse to that of a charging potential for a toner image at the position at which the photosensitive drum 211 and the continuous paper 1 contact with each other to charge the continuous paper 1 so that the toner image may be attracted/transferred from the photosensitive drum 211 to the continuous paper 1.

The separation charger (medium separation section) 212*b* is disposed adjacent the transfer unit 212 on the downstream side with respect to the transfer charger 212*a* along the transport path of the continuous paper 1 and charges the continuous paper 1 to cancel/remove charge of the continuous paper 1 after a toner image has been transferred to the continuous paper 1 in order to facilitate separation of the continuous paper 1 from the photosensitive drum 211.

It is to be noted that the outer circumferential face of the photosensitive drum 211 which has passed the transfer position to the continuous paper 1 passes the cleaning unit 220 as the photosensitive drum 211 further rotates in the direction of the arrow mark a and, thereupon, remaining toner powder on the outer circumferential face of the photosensitive drum 211 is removed by the cleaning unit 220 as described above.

Further, a transfer guide roller 77 is provided on the upstream side with respect to the transfer unit 212 along the transport path of the continuous paper 1. The transfer guide roller 77 rotates with the continuous paper 1 held between the photosensitive drum 211 and the transfer guide roller 77 to guide the continuous paper 1 in the printing transport direction.

Figure 6A:
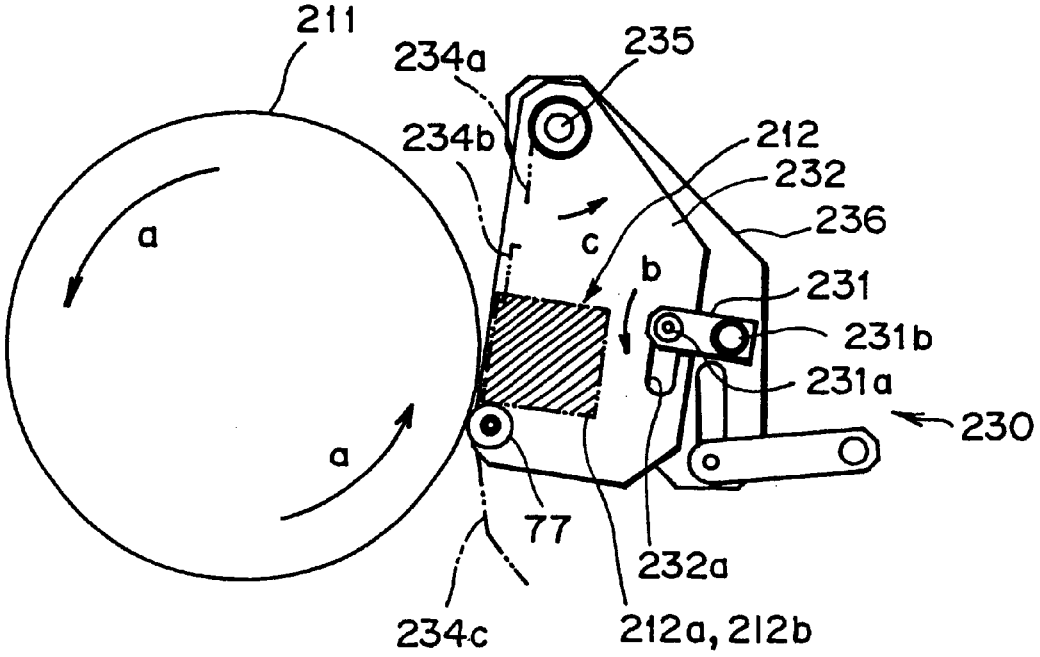
FIGS. 6A and 6B are side elevational views showing a construction of part of a transfer charger contacting mechanism/roller contacting mechanism of the continuous medium printing apparatus shown in FIG. 1 when the transfer charger contacting mechanism/roller contacting mechanism are in a contacting position and in a separating state, respectively.
Figure 6B:
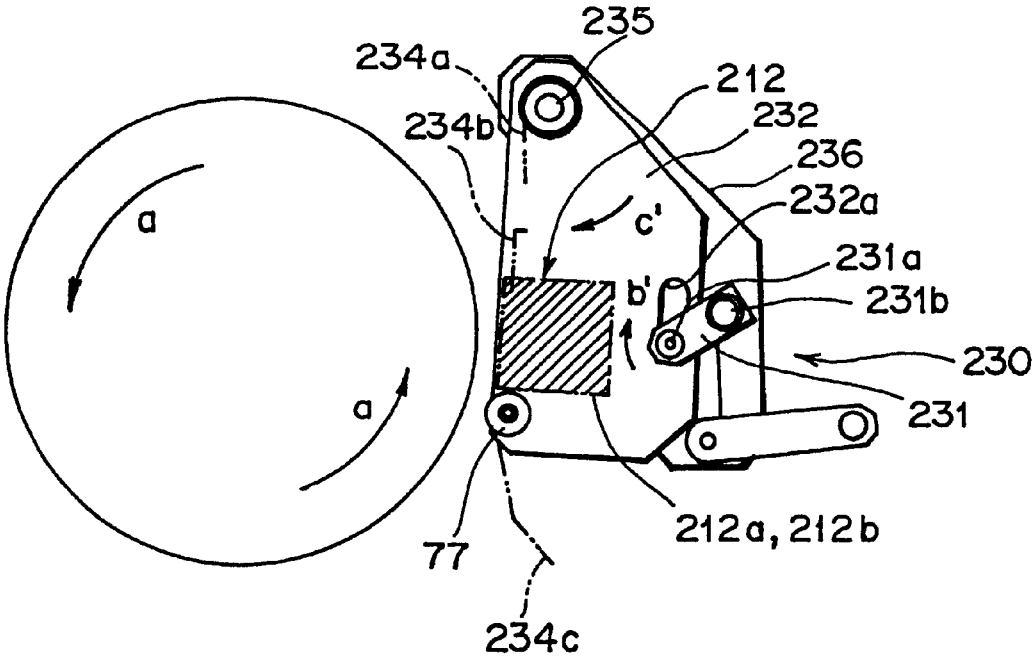

The transfer unit 212 and the transfer guide roller 77 are driven to be brought into and out of contact with the photosensitive drum 211 by a contacting mechanism 230 shown in FIGS. 6A and 6B. The contacting mechanism 230 is controlled by the mechanism control section 100 which will be hereinafter described. The continuous paper 1 passes between the transfer unit 212/transfer guide roller 77 and the photosensitive drum 211, and contacts with the photosensitive drum 211 in a condition wherein the transfer unit 212/transfer guide roller 77 are positioned close to the photosensitive drum 211 as shown in FIG. 6A by the contacting mechanism 230. On the other hand, the continuous paper 1 is separated away from the photosensitive drum 211 in another condition wherein the transfer unit 212/transfer guide roller 77 are separated away from the photosensitive drum 211 as shown in FIG. 6B by the contacting mechanism 230. It is to be noted that the continuous paper 1 is not shown in FIGS. 6A and 6B.

As shown in FIGS. 6A and 6B, the contacting mechanism 230 includes a pair of side plates 232 (only one is shown) for holding the transfer unit 212 and the transfer guide roller 77 from the opposite sides of them, a pair of contacting arms 231 (only one is shown), and a stepping motor (not shown) for driving the contacting arms 231 to pivot.

The side plates 232 are mounted at upper portions thereof on a pair of jamming processing side plates 236 (only one is shown) by a pivot shaft 235 for pivotal motion around the pivot shaft 235 with respect to the jamming processing side plates 236. Each of the side plates 232 has a guideway 232*a* formed therein and extending substantially in parallel to a direction along which the transfer charger 212*a*, separation charger 212*b* and transfer guide roller 77 are arranged.

A slide shaft 231*a* is mounted at end portions of the contacting arms 231 and is fitted for sliding movement in and along the guideways 232*a*. The contacting arms 231 are mounted at the other end portions thereof on the corresponding jamming processing side plates 236 by a pivot shaft 231*b* such that the contacting arms 231 can be pivoted around an axis of the pivot shaft 231*b* with respect to the jamming processing side plates 236. A stepping motor (not shown) whose operation is controlled by the mechanism control section 100 which will be hereinafter described is connected to the pivot shaft 231*b* so that the contacting arms 231 are driven to pivot around the axis of the pivot shaft 231*b* by the stepping motor.

If the contacting arms 231 are driven to pivot in a direction indicated by an arrow mark b by the stepping motor while the transfer unit 212/transfer guide roller 77 are positioned close to the photosensitive drum 211 as shown in FIG. 6A, then the slide shaft 231*a* of the contacting arms 231 is moved under the guidance of the guideways 232*a*. Upon the movement of the slide shaft 231*a*, the side plates 232 are pivoted in a direction indicated by an arrow mark c in FIG.

6A until the transfer unit 212 and the transfer guide roller 77 are separated away from the photosensitive drum 211 together with the continuous paper 1 as shown in FIG. 6B.

If the contacting arms 231 are driven to be pivoted in a direction indicated by an arrow mark b' by the stepping motor reversely to that described above while the transfer unit 212/transfer guide roller 77 are separated from the photosensitive drum 211 as shown in FIG. 6B, then the slide shaft 231*a* of the contacting arms 231 is moved under the guidance of the guideways 232*a*. Upon the movement of the slide shaft 231*a*, the side plates 232 are pivoted in a direction indicated by an arrow mark c' until the transfer unit 212 and the transfer guide roller 77 are positioned close to the photosensitive drum 211 together with the continuous paper 1 as shown in FIG. 6A.

It is to be noted that guides 234*a* to 234*c* for guiding the continuous paper 1 are provided on the side plates 232.

The second transfer process unit 260 is disposed above the first transfer process unit 250 described above and transfers a toner image onto the surface of the continuous paper 1 by electrophotography under the control of the mechanism control section 100 which will be hereinafter described. The second transfer process unit 260 has a structure substantially similar to that of the first transfer process unit 250 and is configure/arranged in a substantially symmetrical relationship to the first transfer process unit 250 with respect to a vertical plane.

It is to be noted that, in FIGS. 1 to 5, like or corresponding components of the second transfer process unit 260 to those of the first transfer process unit 250 described hereinabove are denoted by like reference symbols and overlapping description of them is omitted herein. Further, also the second transfer process unit 260 has a contacting mechanism 230 having a similar construction to that described hereinabove with reference to FIGS. 6A and 6B.

The first fixing unit 410 and the second fixing unit 420 fix toner images transferred to the rear face and the front face of the continuous paper 1 to the continuous paper 1, and in the present embodiment, a flash fixing unit is used for the fixing units 410 and 420. The first fixing unit 410 and the second fixing unit 420 have a similar construction. In particular, each of the fixing units 410 and 420 includes a pair of flash lamps 412, a reflecting mirror 411 and an opposing reflecting mirror 413.

The flash lamps 412 emit flashlight for fixing a toner image to the continuous paper 1, and, for example, a xenon lamp is used for the flash lamps 412. The reflecting mirror 411 is disposed behind the flash lamps 412 and reflects flashlight of the flash lamps 412 toward a fixing face of (a toner image on) the continuous paper 1. The opposing reflecting mirror 413 is positioned in an opposing relationship to the flash lamps 412 and the reflecting mirror 411 across the continuous paper 1 for reflecting flashlight from the flash lamps 412 so as to be irradiated efficiently upon the continuous paper 1.

The first fixing unit 410 is disposed on the downstream side with respect to the first transfer process unit 250 and fixes a toner image transferred to the rear face of the continuous paper 1 by the first transfer process unit 250. The second fixing unit 420 is disposed on the downstream side with respect to the second transfer process unit 260 and fixes another toner image transferred to the front face of the continuous paper 1 by the second transfer process unit 260. It is to be noted that, in the present embodiment, the second fixing unit 420 is disposed on the downstream side with respect to the first fixing unit 410.

The first fixing unit 410 and the second fixing unit 420 are surrounded by a duct 83 connected to and communicated with the blower 8 so that smoke, odor and so forth composed of high molecular organic substances such as styrene, butadiene and phenol generated from the first fixing unit 410 and the second fixing unit 420 may be collected through the duct 83.

The blower 8 includes a fan 81 and a filter 82 which includes activated carbon or a like substance. Air in the duct 83 is exhausted by the fan 81 so that it may be exhausted to the outside of the present apparatus by the fan 81 after smoke and so forth generated by the fixing units 410 and 420 are collected through the duct 83 and odor and so forth in the air are attracted by the filter 82.

The transport system 700 transports the continuous paper 1 from the paper hopper 10 to the stacker 60 along the transport path. By the transport system 700, the continuous paper 1 is first drawn out from the paper hopper 10 and then transported so that it successively passes the positions of the first transfer process unit 250, second transfer process unit 260, first fixing unit 410 and second fixing unit 420 along the transport path while it is printed by them, whereafter it is sent out into the stacker 60.

The transport system 700 includes a transport tractor 710, a guide member 75, transfer guide rollers 77, an automatic loading guide (transport guide) 32, folding back rollers 41, 42 and 51, 52, a discharging roller 761, scuff rollers 781 and 791, and pinch rollers 762, 782 and 792.

The transport tractor 710 is a transport apparatus for transporting the continuous paper 1 and includes a plurality of (two in the present embodiment) tractor mechanisms 72 and 73. The tractor mechanisms 72 and 73 have a similar construction and each includes a driving shaft 722 and a driven shaft 723 disposed in parallel to each other and an endless tractor belt 721 extending between and around the driving shaft 722 and the driven shaft 723. The tractor belt 721 has feed pins provided in an equally separated relationship from each other along the opposite sides thereof for engaging with feed holes formed along the opposite sides of the continuous paper 1.

A driving belt 725 extends between and around the driving shaft 722 of the tractor mechanism 72 and the driving shaft 722 of the tractor mechanism 73, and a drive motor 724 is connected to the driving shaft 722 of the tractor mechanism 72. The drive motor 724 can drive the driving shaft 722 of the tractor mechanism 72 to rotate at any velocity in any direction. When the driving shaft 722 of the tractor mechanism 72 is driven to rotate by the drive motor 724, the driving force is transmitted also to the driving shaft 722 of the tractor mechanism 73 by the driving belt 725 so that the tractor belts 721 of the tractor mechanisms 72 and 73 are driven to circulate in synchronism with each other in the same direction so that the continuous paper 1 can be transported in any of the printing transporting direction and the direction reverse to the printing transporting direction.

Further, the transport tractor 710 includes a back tension roller 71 disposed between the tractor mechanism 73 and the tractor mechanism 72 (that is, on the upstream side with respect to the tractor mechanism 72 on the downstream side) for exerting a tension to act upon the continuous paper 1 in the direction reverse to the printing transporting direction of the continuous paper 1. The back tension roller 71 includes a pair of presser rollers, that is, a driving side presser roller 711 and a driven side presser roller (pinch roller) 712.

A drive motor 714 is connected to the driving side presser roller 711 so that the driving side presser roller 711 can be driven to rotate at any velocity in the printing transporting direction of the continuous paper 1 or the direction reverse to the printing transporting direction by the drive motor 714.

The driven side presser roller (pinch roller) 712 presses the continuous paper 1 from above against the driving side presser roller 711 and is driven to rotate by transportation of the continuous paper 1.

In particular, the back tension roller 71 exerts a tension to act upon the continuous paper 1 in the direction reverse to the printing transporting direction as the driving side presser roller 711 is driven to rotate in the direction reverse to the printing transporting direction of the continuous paper 1 by the drive motor 714 while the continuous paper 1 is held between the driving side presser roller 711 and the driven side presser roller 712. Consequently, the tension acts upon the continuous paper 1 in the direction reverse to the printing transporting direction thereby to keep the continuous paper 1 taut.

The guide member 75 guides the continuous paper 1 sent out in a horizontal direction from the transport tractor 710 (tractor mechanism 72) toward a vertically upward direction along the transport path, and is formed from a curved plate-like member.

The transfer guide rollers 77 are provided individually for the transfer process units 250 and 260 as described hereinabove and each rotates with the continuous paper 1 held between the photosensitive drum 211 and the transfer guide roller 77 to guide the continuous paper 1 in the printing transporting direction.

It is to be noted that the transfer guide rollers 77 and the folding back rollers 41 and 42 which are hereinafter described are charged to the same polarity as that of non-fixed toner powder on the continuous paper 1. Consequently, when the folding back rollers 41 and 42 and the transfer guide rollers 77 contact with non-fixed toner powder on the continuous paper 1, the toner powder does not stick to any of the folding back rollers 41 and 42 and the transfer guide rollers 77, thereby preventing otherwise possible damage to a toner image transferred to the continuous paper 1. Further, the folding back rollers 41 and 42 and the transfer guide rollers 77 are allowed to rotate only in the printing transporting direction.

The automatic loading guide (transport guide) 32 is disposed between the first transfer process unit 250 and the second transfer process unit 260 as shown in FIGS. 1 to 4 and guides the continuous paper 1 along the transport path (that is, toward an upward direction) from the first transfer process unit 250 to the second transfer process unit 260.

The folding back rollers (transport rollers, medium transport means) 41 and 42 are disposed in an opposing relationship to each other across the continuous paper 1 between the second transfer process unit 260 and the first fixing unit 410 such that they contact with the rear face and the front face of the continuous paper 1, respectively. A drive motor (not shown) is connected to each of the folding back rollers 41 and 42 so that the folding back rollers 41 and 42 are individually driven to rotate by the drive motors.

The continuous paper 1 is wrapped over a predetermined angle around the folding back roller 41 so that the transportation direction of the continuous paper 1 may be changed such that the angle defined between the transporting direction of the continuous paper 1 in the second transfer process unit 260 and the transporting direction of the continuous paper 1 in the first fixing unit 410 may be greater than a predetermined angle. The folding back rollers 41 and 42 function also as light intercepting members for preventing light leaking from the first fixing unit 410 and the second fixing unit 420 from reaching the first transfer process unit 250 and the second transfer process unit 260. It is to be rioted that a light interception member 43 for intercepting leaking light from the first fixing unit 410 is disposed between the second transfer process unit 260 and the first fixing unit 410.

Since the folding back rollers 41 and 42 change the transporting direction of the continuous paper 1 and function as light intercepting members as described above, leaking light from the first fixing unit 410 and the second fixing unit 420 can be prevented from reaching the photosensitive drum 211 of the first transfer process unit 250 and the second transfer process unit 260 and the lives of the photosensitive drums 211 can be prevented from being shortened by deterioration by light. Further, deterioration of the print quality by a drop of the surface potentials of the photosensitive drums 211 can be prevented.

The folding back rollers 51 and 52 are disposed in an opposing relationship to each other across the continuous paper 1 between the first fixing unit 410 and the second fixing unit 420 such that they contact with the rear face and the front face of the continuous paper 1, respectively. The continuous paper 1 is wrapped over a predetermined angle around the folding back roller 51 so that the transporting direction of the continuous paper 1 may be changed such that the angle defined between the transporting direction of the continuous paper 1 in the first fixing unit 410 and the transporting direction of the continuous paper 1 in the second fixing unit 420 is greater than a predetermined angle. It is to be noted that the folding back roller 52 is formed as a pinch roller which presses the continuous paper 1 from above against the folding back roller 51 and is driven to rotate by transportation of the continuous paper 1. Further, a drive motor (not shown) is connected to the folding back roller 52 so that the folding back roller 51 is driven to rotate by the drive motor.

A frictional force exerted between the surface of the continuous paper 1 and the surface of the folding back roller 51 as the continuous paper 1 is wrapped over the predetermined angle around the folding back roller 51 acts as a reactive force upon the continuous paper 1 when the continuous paper 1 is transported by the transport tractor 710 so that the continuous paper 1 can always be kept taut during transportation thereof.

It is to be noted that, while, in the present embodiment, the folding back roller 51 contacts with the rear face of the continuous paper 1, a toner image on the rear face of the continuous paper 1 at the folding back roller 51 has been fixed already by the first fixing unit 410, and consequently, even if the toner image contacts with the folding back roller 51, it is not disturbed by the folding back roller 51 and the print quality of the continuous paper 1 is not deteriorated.

Further, since the second fixing unit 420 can be disposed at a low position by changing the transporting direction of the continuous paper 1 by means of the folding back roller 51 so that the transporting direction of the continuous paper 1 in the second fixing unit 420 may be a substantially horizontal direction, the height of the transport path of the continuous paper 1 can be made low and the apparatus can be reduced in size.

Furthermore, also by changing the transporting direction of the continuous paper 1 by means of the folding back roller 51, light leaking from the second fixing unit 420 can be prevented from reaching the photosensitive drums 211 of the first transfer process unit 250 and the second transfer process unit 260. The folding back roller 51 has also a function of preventing leaking light from the second fixing unit 420 from propagating along the front face of the continuous paper 1 until it reaches the second transfer process unit 260 thereby to intercept the leaking light from the second fixing unit 420.

The discharging roller 761 and the pinch roller 762 are disposed in an opposing relationship to each other across the continuous paper 1 on the downstream side with respect to the second fixing unit 420 such that they contact with the rear face and the front face of the continuous paper 1, respectively. The continuous paper 1 is wrapped over a predetermined angle around the discharging roller 761 so that the transporting direction of the continuous paper 1 may be changed from a horizontal direction to a downward direction. It is to be noted that the pinch roller 762 presses the continuous paper 1 from above against the discharging roller 761 and is driven to rotate by transportation of the continuous paper 1. A drive motor (not shown) is connected to the discharging roller 761 so that the discharging roller 761 may be driven to rotate by the drive motor.

The scuff roller 781 and the pinch roller 82 are disposed in an opposing relationship to each other across the continuous paper 1 on the downstream side with respect to the discharging roller 761 and the pinch roller 762 such that they contact with the rear face and the front face of the continuous paper 1, respectively.

The scuff roller 781 and the pinch roller 782 rotate while they hold the continuous paper 1 therebetween to exert a feeding force to act upon the continuous paper 1. The continuous paper 1 is wrapped over a predetermined angle around the scuff roller 781, and when the scuff roller 781 is driven to rotate by a drive motor (not shown), the scuff roller 781 slidably contacts with the continuous paper 1 and exerts a feeding force to act upon the continuous paper 1 to transport the continuous paper 1.

The scuff roller 791 and the pinch roller 792 are disposed in the proximity of the entrance of the stacker 60 on the downstream side with respect to the scuff roller 781 and the pinch roller 782 and function similarly as the scuff roller 781 and the pinch roller 782 described above, respectively. Thus, detailed overlapping description of the scuff roller 791 and the pinch roller 792 is omitted herein to avoid redundancy.

It is to be noted that the flash fixing unit power supply 9 supplies power to the flash lamps 412 of the first fixing unit 410 and the second fixing unit 420.

The continuous paper printer of the present embodiment is composed of two parts of a first housing 1001 and a second housing 1002. In the first housing 1001, the first transfer process unit 250, second transfer process unit 260, first fixing unit 410, second fixing unit 420 and transport system 700 described above are disposed, and also the mechanism control section 100 (not shown in FIG. 5; refer to FIG. 7) which will be hereinafter described and a main power supply apparatus (not shown) for supplying power to the first transfer process unit 250, second transfer process unit 260, transport system 700 and so forth are disposed. In the second housing 1002, the blower 8, stacker 60 and flash fixing unit power supply 9 are disposed, and also the scuff rollers 781 and 791 and the pinch rollers 782 and 792 which are components of the transport system 700 are disposed.

In the transport tractor 710, a medium trailing end detection section 74 for detecting a trailing end of the continuous paper 1 is mounted on the upstream side with respect to the tractor mechanism 73. The medium trailing end detection section 74 includes, for example, a photo-sensor including a light emitting element and a light receiving element and is disposed such that the continuous paper 1 intercepts light between the light emitting element and the light receiving element. Thus, when the continuous paper 1 which intercepts light between the light emitting element and the light receiving element disappears, the light receiving element of the medium trailing end detection section 74 detects light from the light emitting element, and such detection is displayed on a display unit 111 of an operation panel 110 shown in FIG. 7 or a like device to notify the operator that the trailing end of the continuous paper 1 has been detected.

Further, in the continuous paper printer of the present embodiment (in the first housing 1001), a leading end detection sensor 310 and automatic loading sensors 311 to 313 are provided as shown in FIGS. 1 to 4. The sensors 310 to 313 are used to detect, upon automatic loading (automatic mounting) of the continuous paper 1 into the continuous paper printer, to which position the continuous paper 1 has been transported in the continuous paper printer. The sensors 310 to 314 are each formed from, for example, a photo-sensor including a light emitting element and a light receiving element, and presence of the continuous paper 1 (arrival of the continuous paper 1 at the position of the photo-sensor) is detected by interception of light to be introduced from the light emitting element into the light receiving element by the continuous paper 1.

The leading end detection sensor 310 is disposed on the exit side of the transport tractor 710 (tractor mechanism 72) and detects a leading end 1*a* of the continuous paper 1 to detect that the continuous paper 1 has begun to be sent out from the tractor mechanism 72.

The automatic loading sensor 311 is disposed on the entrance side of the transfer unit 212 of the first transfer process unit 250 (on the upstream side with respect to the transfer guide roller 77) and detects that the leading end 1*a* of the continuous paper 1 has reached the position.

Similarly, the automatic loading sensor 312 is disposed on the entrance side of the transfer unit 212 of the second transfer process unit 260 (on the upstream side with respect to the transfer guide roller 77) and detects that the leading end 1*a* of the continuous paper 1 has reached the position.

The automatic loading sensor 313 is disposed on the exit side of the folding back rollers 41 and 42 which function as transport rollers, and detects that the leading end 1*a* of the continuous paper 1 has reached the position.

Figure 7:
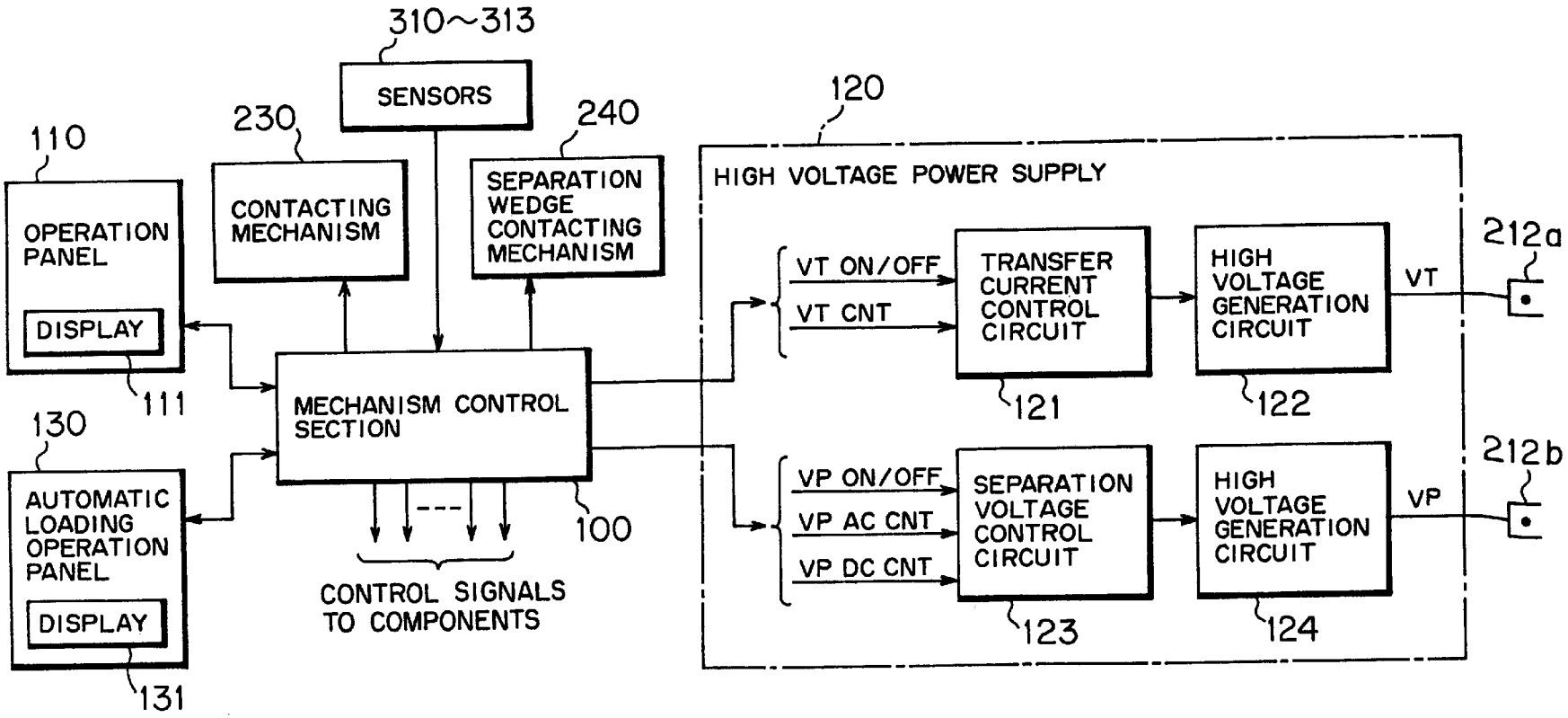
FIG. 7 is a block diagram showing a construction of part of a control system of the continuous medium printing apparatus of FIG. 1.

Results of detection of the sensors 310 to 313 are inputted to the mechanism control section 100 (refer to FIG. 7).

Further, each of the first transfer process unit 250 and the second transfer process unit 260 of the continuous paper printer of the present embodiment includes such a separation wedge (medium separation element) 30 as shown in FIGS. 1 to 4.

The separation wedge 30 is disposed in the proximity of the photosensitive drum 211 for separating a leading end portion 1*b* of the continuous paper 1 sent out in the printing transporting direction in a condition attracted to the photosensitive drum 211 from the photosensitive drum 211 when the continuous paper 1 is automatically loaded (automatically mounted) into the continuous paper printer. In the present embodiment, also a separation wedge contacting mechanism 240 (refer to FIG. 7) for moving the separation wedge 30 into and out of contact with the photosensitive drum 211 is provided. It is to be noted that, for the separation wedge contacting mechanism 240, a separation wedge contacting mechanism having a construction similar to that of the contacting mechanism 230 described hereinabove with reference to FIGS. 6A and 6B is used.

The components of the continuous paper printer of the present embodiment, that is, the transport system 700, first transfer process unit 250, second transfer process unit 260, first fixing unit 410, second fixing unit 420, stacker 60, blower 8 and flash fixing unit power supply 9 are controlled by the mechanism control section (control section) 100 shown in FIG. 7.

The mechanism control section 100 has various controlling functions including a function of selectively switching the printing mode of the continuous paper printer upon ordinary printing upon the continuous paper 1 among a front face printing mode in which printing is performed only for the front face of the continuous paper 1, a rear face printing mode in which printing is performed only for the rear face of the continuous paper 1 and a double-sided printing mode in which printing is performed for both of the front and rear faces of the continuous paper 1.

In the front face printing mode, the mechanism control section 100 controls the second transfer process unit 260, second fixing unit 420 and transport system 700 to print only on the front face of the continuous paper 1. In this instance, the transfer unit 212 and the transfer guide roller 77 of the first transfer process unit 250 are in a condition separated away from the photosensitive drum 211 by the contacting mechanism 230 as seen in FIG. 6B. Consequently, the continuous paper 1 is separated away not only from the photosensitive drum 211 but also from the transfer unit 212 and the transfer guide roller 77 so that it can be prevented that an unnecessary force acts upon the continuous paper 1 or unnecessary toner powder sticks to the continuous paper 1. Meanwhile, the transfer unit 212 and the transfer guide roller 77 of the second transfer process unit 260 are positioned close to the photosensitive drum 211 by the contacting mechanism 230 as seen in FIG. 6A, and the continuous paper 1 is held between the photosensitive drum 211 and the transfer unit 212/transfer guide roller 77.

Similarly, in the rear face printing mode, the mechanism control section 100 controls the first transfer process unit 250, first fixing unit 410 and transport system 700 to print only on the rear face of the continuous paper 1. In this instance, the transfer unit 212 and the transfer guide roller 77 of the second transfer process unit 260 are separated away from the photosensitive drum 211 by the contacting mechanism 230 as seen in FIG. 6B. Meanwhile, the transfer unit 212 and the transfer guide roller 77 of the first transfer process unit 250 are positioned close to the photosensitive drum 211 by the contacting mechanism 230 as seen in FIG. 6A, and the continuous paper 1 is held between the photosensitive drum 211 and the transfer unit 212/transfer guide roller 77.

Further, in the double-sided printing mode, the mechanism control section 100 controls the first transfer process unit 250, first fixing unit 410, second transfer process unit 260, second fixing unit 420 and transport system 700 to print on both of the front and rear faces of the continuous paper 1. In this instance, not only the transfer unit 212 and the transfer guide roller 77 of the first transfer process; unit 250 but also the transfer unit 212 and the transfer guide roller 77 of the second transfer process unit 260 are positioned close to the respective photosensitive drums 211 by the contacting mechanisms 230 as seen in FIG. 6A, and the continuous paper 1 is held between the photosensitive drum 211 and the transfer unit 212/transfer guide roller 77 of each of the first transfer process unit 250 and the second transfer process unit 260.

Now, a construction of essential part of the control system of the continuous paper printer of the present embodiment is described with reference to FIG. 7 which shows part of the control system. The mechanism control section (control section) 100 of the continuous paper printer of the present embodiment controls the components of the continuous paper printer including the transport system 700, first transfer process unit 250, second transfer process unit 260, first fixing unit 410, second fixing unit 420, stacker 60, blower 8 and flash fixing unit power supply 9. Since the present invention is characterized particularly in an automatic loading operation for the continuous paper 1, those functions of the mechanism control section 100 which relate to an automatic loading operation for the continuous paper 1 are described below.

The mechanism control section 100 controls, upon automatic loading of the continuous paper 1, transporting operations by the transport tractor 710 and the transporting rollers 41 and 42, rotating conditions of the photosensitive drums 211, charging operations of the prechargers 215, transfer chargers 212*a* and separation chargers; 212*b*, applying operations of a bias voltage to the development units 219 with a toner hopper and contacting operations of the contacting mechanisms 230 and the separation wedge contacting mechanisms 240 based on results of detection by the sensors 310 to 313 and printing conditions (for example, the width/thickness of the continuous paper 1) inputted from the operation panel 110 as hereinafter described with reference to FIGS. 1 to 4 and 12A to 12N.

Further, the mechanism control section 100 performs controlling operations based on information inputted from the operation panel 110 and/or an automatic loading operation panel 130, and functions as a perforation position determination section as hereinafter described with reference to FIGS. 13 to 16. Further, the mechanism control section 100 controls the display unit 111 of the operation panel 110 and a display unit 131 of the automatic loading operation panel 130 so that they may each function as a perforation position indication section.

It is to be noted that the operation panel (printing condition inputting section) 110 is disposed on a side face of a body or some other suitable location of the continuous paper printer of the present embodiment and is operated by an operator so as to effect inputting/setting to the continuous paper printer and so forth. The automatic loading operation panel 110 includes the display unit (display section) 111 for displaying various conditions of the continuous paper printer. Meanwhile, the automatic loading operation panel (printing condition inputting section) 130 is disposed in the proximity of the transport tractor 710 and used exclusively to operate automatic loading of the continuous paper 1. Thus, the automatic loading operation panel 130 is operated by an operator to effect inputting/setting and so forth relating to automatic loading of the continuous paper 1 and includes the display unit (display section) 131 for displaying various conditions relating to such automatic loading.

Further, the mechanism control section 100 controls charging conditions of the transfer chargers 212*a* and the separation chargers 212*b* through a high voltage power supply 120 as seen from FIG. 7.

The high voltage power supply 120 includes a transfer current control circuit 121 and a high voltage generation circuit 122 for controlling a transfer current VT to be supplied to the transfer chargers 212*a*, and a separation voltage control circuit 123 and a high voltage generation circuit 124 for controlling an AC voltage VP to be supplied to the separation chargers 212*b*.

Figure 8:
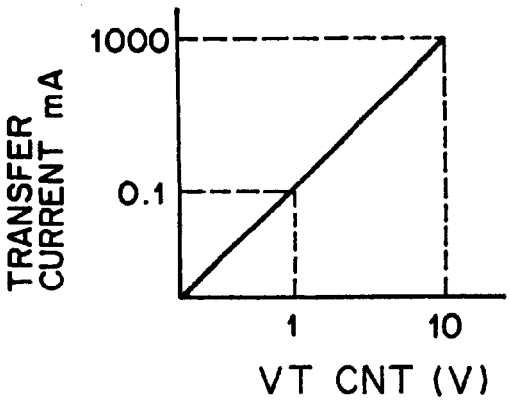
FIG. 8 is a diagram illustrating a control voltage for controlling transfer current in the continuous medium printing apparatus of FIG. 1.

The mechanism control section 100 provides, in order to control the transfer current VT to be supplied to a transfer charger 212*a*, on/off information VT ON/OFF (a 1-bit signal) for the transfer charger 212*a* and a control voltage VT CNT (1 to 10 V) for designating the magnitude of the transfer current VT to the transfer current control circuit 121. If information VT ON for turning a transfer charger 212*a* on is received, then the transfer current control circuit 121 controls the high voltage generation circuit 122 to supply transfer current VT (0.1 to 1,000 mA) corresponding to the control voltage VT CNT (1 to 10 V) to the transfer charger 212*a*, for example, based on such a characteristic as illustrated in FIG. 8.

Figure 9A:
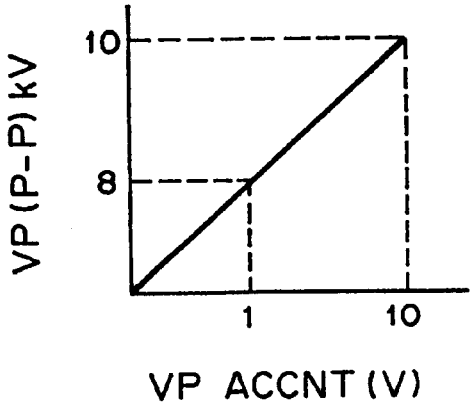
FIGS. 9A and 9B are diagrams illustrating control voltages for controlling separation voltages (P-P voltage and offset voltage) in the continuous medium printing apparatus of FIG. 1.
Figure 9B:
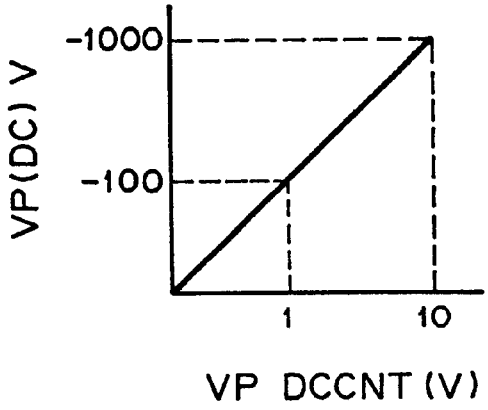

Further, the mechanism control section 100 provides, in order to control the AC voltage VP to be applied to a separation charger 212*b*, on/off information VP ON/OFF (a 1-bit signal) for the transfer charger 212*a*, a control voltage VP ACCNT (1 to 10 V) for designating a P-P (peak to peak) value VP(P-P) of the AC voltage VP and a control voltage VP DCCNT (1 to 10 V) for designating an offset value VP(DC) of the AC voltage VP to the separation voltage control circuit 123. If the information VP ON for turning a separation charger 212*b* on is received, then the separation voltage control circuit 123 controls the high voltage generation circuit 124 to apply an AC voltage VP having a P-P value VP(P-P) and an offset value VP(DC) corresponding to the control voltages VP ACCNT (1 to 10 V) and VP DCCNT (1 to 10 V), for example, based on such characteristics as illustrated in FIGS. 9A and 9B.

Now, basic controlling operation of the mechanism control section 100 of the continuous paper printer of the present embodiment upon automatic loading is described.

In particular, when automatic loading of the continuous paper 1 is started in response to depression of an automatic loading start switch (not shown) of the automatic loading operation panel 130 after the continuous paper 1 is set in position into the tractor mechanism 73, the mechanism control section 100 controls the charging operations of the transfer chargers 212*a* and the prechargers 215 in order beginning with the transfer charger 212*a* on the upstream side on the transport path so that the leading end portion 1*b* of the continuous paper 1 may be electrostatically attracted to the photosensitive drums 211 and further controls the rotation conditions of the photosensitive drums 211 so that the photosensitive drums 211 are rotated in the printing transporting direction with the continuous paper 1 attracted thereto in order beginning with the upstream side photosensitive drum 211 on the transport path to exert a transporting force to act upon the continuous paper 1 to transport the continuous paper 1 in the printing transporting direction.

In the present embodiment, as a medium separating member for separating the leading end portion 1*b* of the continuous paper 1 attracted to each of the photosensitive drums 211 away from the photosensitive drum 211 as the leading end portion 1*b* of the continuous paper 1 is sent out in the printing transporting direction while it is attracted to the photosensitive drum 211, the separation wedge 30 described above is used and also the transfer charger 212*a* which forms the transfer unit 212 is used. In this instance, the mechanism control section 100 controls the separation charger 212*b* so that the separation voltage VP used upon automatic loading of the continuous paper 1 may be set higher than the separation voltage used upon ordinary printing on the continuous paper 1 (the absolute values of the P-P value and the offset value mentioned above may have comparatively high values). This augments the separation performance of the continuous paper 1 from the photosensitive drums 211. Further, the mechanism control section 100 controls each of the separation chargers 212*b* so that the charging operation of the same may be ended after completion of a charging operation by the transfer charger 212*a* to automatically load the continuous paper 1.

Further, the mechanism control section 100 controls the charging operation of the transfer charger 212*a* in each of the transfer process units 250 and 260 so that the leading end portion 1*b* of the continuous paper 1 may be electrostatically attracted to the photosensitive drum 211 after the leading end 1*a* of the continuous paper 1 passes the position of the separation wedge 30. Consequently, in the present embodiment, a predetermined region of the leading end portion 1*b* of the continuous paper 1 from the leading end 1*a* (a region of a distance between the transfer charger 212*a* and the separation wedge 30; for example, 4 to 5 cm) is set as a non-charged region.

Furthermore, the mechanism control section 100 controls operation of each of the separation wedge contacting mechanisms 240 to position the separation wedge 30 close to the photosensitive drum 211 upon charging operation by the transfer charger 212*a* in an automatic loading operation of the continuous paper 1 and separate the separation wedge 30 away from the photosensitive drum 211 after completion of the charging operation by the transfer charger 212*a*.

Further, the mechanism control section 100 in the present embodiment controls the transfer chargers 212*a* and the separation chargers 212*b* so that the electrostatic attracting force between the continuous paper 1 and each of the photosensitive drums 211 may be varied in accordance with printing conditions. As such printing conditions, medium conditions including a characteristic of the continuous paper 1 inputted from the operation panel 110 by an operator, for example, a paper length/paper thickness (width/thickness of the continuous paper 1) are given.

For example, with regard to the transfer current VT to be supplied to each of the transfer chargers 212*a*, the mechanism control section 100 reads out a value corresponding to a paper length/paper thickness from such a setting table as shown in FIG. 10 and controls the transfer charger 212*a* based on the value. Further, with regard to the AC voltage VP to be applied to each of the separation chargers 212*b*, the mechanism control section 100 reads out a value corresponding to the paper length/paper thickness from such a setting table as shown in FIG. 11 and controls the separation charger 212*b* based on the value.

It is to be noted that, where the prechargers 215 are used as charging sections for causing the continuous paper 1 to be electrostatically attracted to the photosensitive drums 211 upon automatic loading of the continuous paper 1, the mechanism control section 100 may control each of the prechargers 215 so that the charging potential of the photosensitive drum 211 may be varied in accordance with the printing conditions.

Further, as the printing conditions, apparatus installation environment conditions such as, for example, a temperature/humidity may be given. In this instance, the continuous paper printer is constructed such that it includes sensors for detecting the temperature/humidity and setting tables for providing a transfer current value and/or a separation voltage value corresponding to the temperature/humidity and the mechanism control section 100 reads out values corresponding to results of detection of the temperature/humidity by the sensors from the setting tables and controls the transfer chargers 212*a*, separation chargers 212*b* and/or prechargers 215 based on the values.

Furthermore, the mechanism control section 100 in the present embodiment controls the rotation condition of each of the photosensitive drums 211 so that, upon automatic loading of the continuous paper 1, the circumferential velocity of the photosensitive drum 211 may be equal to or higher than the transport velocity of the continuous paper 1.

In addition, the mechanism control section 100 in the present embodiment controls the photosensitive drum 211 of the first transfer process unit 250 so that the transporting force of the photosensitive drum 211 may be cancelled at a point of time when the leading end portion 1*b* of the continuous paper 1 reaches the photosensitive drum 211 of the second transfer process unit 260 from the first transfer process unit 250 and is electrostatically attracted to the photosensitive drum 211.

Similarly, the mechanism control section 100 in the present embodiment controls the photosensitive drum 211 of the second transfer process unit 260 so that the transporting force of the photosensitive drum 211 may be cancelled at a point of time when the leading end portion 1*b* of the continuous paper 1 reaches the folding back rollers 41 and 42 from the second transfer process unit 260 and is put into a condition wherein it is transported under the transporting force of the folding back rollers 41 and 42. In other words, the photosensitive drum 211 exerts a transporting force to act upon the continuous paper 1 to transport the continuous paper 1 until the leading end portion 1*b* of the continuous paper 1 reaches the folding back rollers 41 and 42.

In the present embodiment, the transporting force by each of the photosensitive drums 211 is cancelled in the following manner. In particular, the mechanism control section 100 controls the transfer charger 212*a* so that it may stop its charging operation for the continuous paper 1 and controls the contacting mechanism 230 so that the transfer unit 212 including the transfer charger 212*a* and the separation charger 212*b* and the transfer guide roller 77 may be separated away from the continuous paper 1 and the photosensitive drum 211 in order to cancel the transporting force by the photosensitive drum 211. It is to be noted that, where the prechargers 215 are used as charging sections for causing the continuous paper 1 to be electrostatically attracted to the photosensitive drums 211 upon automatic loading of the continuous paper 1, the mechanism control section 100 may control each of the prechargers 215 so that it may stop its charging operation for the photosensitive drum 211 to cancel the transporting force by the photosensitive drum 211.

In this instance, the mechanism control section 100 performs the cancellation of the transporting force described above, for example, at such a timing as described below.

In particular, the mechanism control section 100 includes a timer (not shown) which starts its time counting operation at a point of time when the leading end portion 1*b* of the continuous paper 1 passes the position of each of the photosensitive drums 211 and controls the photosensitive drum 211 of the first transfer process unit 250 (the photosensitive drum 211 in the preceding state; hereinafter referred to as first drum 211) or the photosensitive drum 211 of the second transfer process unit 260 (the photosensitive drum 211 in the following stage; hereinafter referred to as second drum 211) so that the transporting force of the same may be cancelled at a point of time when the timer measures a predetermined time after the leading end portion 1*b* of the continuous paper 1 passes the position of the first drum 211 until it is attracted to the second drum 211 or another point of time at which a predetermined time after the leading end portion 1*b* of the continuous paper 1 passes the second drum 211 until it is subject to the transporting force of the folding back rollers 41 and 42 which serves as medium transporting means is measured.

Alternatively, the continuous paper printer includes a sensor for detecting that the leading end portion 1*b* of the continuous paper 1 reaches a position at which it is to be attracted to the second drum 211 or another position at which it is to be held between the folding back rollers 41 and 42 (for example, the automatic loading sensor 313 shown in FIGS. 1 to 4), and the mechanism control section 100 controls the first drum 211 or the second drum 211 to cancel its transporting force at a point of time when the sensor detects that the leading end portion 1*b* of the continuous paper 1 reaches the position at which it is to be attracted by the photosensitive drum 211 or at another point of time when the sensor detects that the leading end portion 1*b* of the continuous paper 1 reaches the position at which it is to be held between the folding back rollers 41 and 42.

Now, an automatic loading operation of the continuous paper 1 by the continuous paper printer of the present embodiment having such a construction as described above is described in more detail. It is to be noted that description of ordinary printing by the continuous paper printer of the present embodiment is omitted here because it is performed in a procedure similar to a conventional procedure.

First, an automatic loading procedure for the continuous paper 1 by the continuous paper printer of the present embodiment is described with reference to FIGS. 1 to 4 and 12A to 12N. It is to be noted that, in the following description, the name of a component of the first transfer process unit 250 is preceded by "first" while the name of a component of the second transfer process unit 260 is preceded by "second".

In order to load a continuous paper 1 into the present continuous paper printer before the continuous paper 1 is printed by the continuous paper printer of the present embodiment, the operator will first set the continuous paper 1 in position into the tractor mechanism 73 on the upstream side of the transport tractor 710 and then depress the automatic loading start switch of the automatic loading operation panel 130. In response to the depression, automatic loading of the continuous paper 1 is started. In other words, the tractor mechanisms 72 and 73 are rendered operative to start transportation of the continuous paper 1 (refer to FIG. 12B). It is to be noted that, upon automatic loading in the present embodiment, the continuous paper 1 is transported at a velocity (for example, 100 mm/sec) equal to approximately ¼ the ordinary printing velocity. This velocity, however, depends upon the specifications of the apparatus and does not relate to any characteristic of the present invention.

As the continuous paper 1 is transported, it is detected by the leading end detection sensor 310 that the leading end 1*a* of the continuous paper 1 passes the tractor mechanism 72 on the downstream side of the transport tractor 710, and then the first drum 211 and the second drum 211 begin to be driven to rotate in the directions each indicated by an arrow mark a in FIGS. 1 to 5 (refer to FIGS. 12D and 12E).

Then, at a point of time when a predetermined time T4 passes after the rotation of the drums 211 is started, the first precharger 215 and the second precharger 215 are rendered operative (refer to FIGS. 12F and 12G). Further, at a point of time when another predetermined time T5 (>T4) passes after the rotation of the drums 211 is started, a bias voltage is applied to the first development unit 219 and the second development unit 219 (refer to FIGS. 12H and 12I). It is to be noted that the bias voltage is applied to the development units 219 in order to prevent toner powder from flowing out from the development units 219 and sticking to the drums 211.

It is to be noted that, in the present embodiment, the first drum 211 and the second drum 211 are charged to a potential opposite to that of the continuous paper 1 by the first precharger 215 and the second precharger 215 thereby to stabilize electrostatic attraction of the continuous paper 1 to the first drum 211 and the second drum 211, respectively.

Thereafter, at a point of time when a predetermined time T7 (for example, 1 second) passes after the leading end 1*a* of the continuous paper 1 is detected by the leading end detection sensor 310, the separation wedge contacting mechanisms 240 are rendered operative to change over the positions of the first separation wedge 30 and the second separation wedge 30 from the positions in which they are separated away from the first drum 211 and the second drum 211 to the positions in which they are close to the first drum 211 and the second drum 211, respectively (refer to FIG. 12N).

Here, in the present embodiment, as seen from FIGS. 12A to 12N, the physical distance between the sensor 310 and the sensor 311 (distance along the transport path of the continuous paper 1) is set so that the time required for the leading end 1*a* of the continuous paper 1 to move from the leading end detection sensor 310 to the sensor 311 at the transporting velocity upon automatic loading may be T1 (for example, 2 seconds). Similarly, the physical distance between the sensor 310 and the sensor 312 (distance along the transport path of the continuous paper 1) is set so that the time required for the leading end 1*a* of the continuous paper 1 to move from the leading end detection sensor 310 to the sensor 312 at the transporting velocity upon automatic loading may be T2 (for example, 4 seconds). Further, the physical distance between the sensor 310 and the sensor 313 (distance along the transport path of the continuous paper 1) is set so that the time required for the leading end 1*a* of the continuous paper 1 to move from the leading end detection sensor 310 to the sensor 313 at the transporting velocity upon automatic loading may be T3 (for example, 7 seconds).

Figure 1:
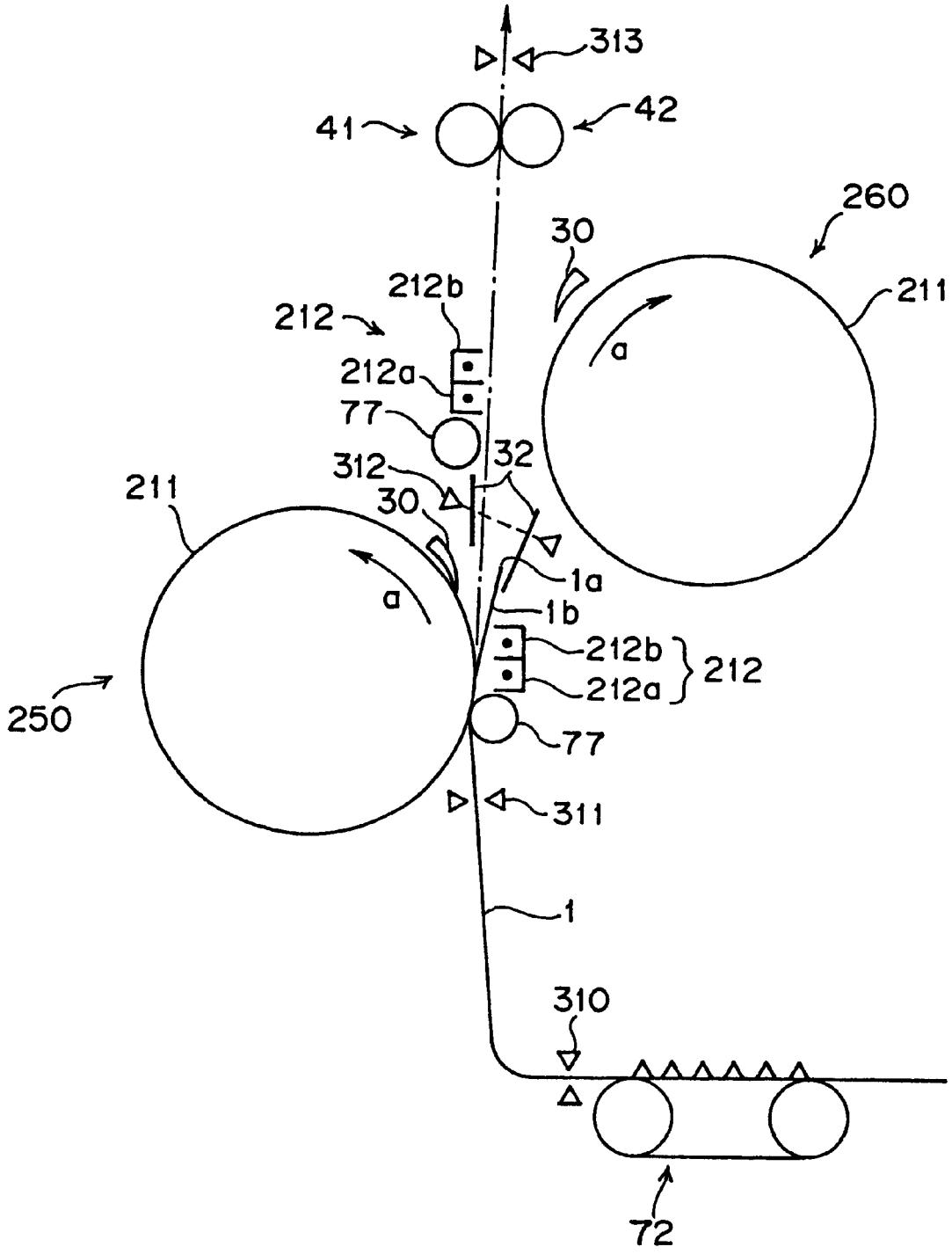
FIGS. 1 to 4 are side elevational views schematically showing part of a continuous medium printing apparatus according to an embodiment of the present invention and illustrating different stages of an automatic loading procedure for a continuous medium.

Then, at a point of time when the leading end 1*a* of the continuous paper 1 passes the first separation wedge 30 after the first separation wedge 30 and the second separation wedge 30 are changed over to the close positions and the leading end 1*a* of the continuous paper 1 is detected by the sensor 311, the first contacting mechanism 230 is rendered operative to change over the positions of the first transfer unit 212 and the transfer guide roller 77 to the positions separated away from the first drum 211 to the positions close to the first drum 211, whereupon the continuous paper 1 is held between the first transfer unit 212/transfer guide roller 77 and the first drum 211 as seen in FIG. 1. Then, the transfer current VT is supplied to the first transfer charger 212*a*, and simultaneously the separation voltage VP which is higher than the separation voltage used upon normal printing is applied to the first separation charger 212*b* (refer to FIGS. 12J and 12L). Although the second separation wedge 30 is shown positioned separated away from the first drum 211 in FIG. 1, according to the control timing illustrated in FIG. 12N, at this pint of time, the first separation wedge 30 still remains close to the second drum 211. However, the second separation wedge 30 may be kept separated away from the second drum 211 as seen in FIG. 1 until the leading end 1*a* of the continuous paper 1 passes the position of the first separation wedge 30.

In this manner, the continuous paper 1 is transported to the upwardly located second transfer process unit 260 by rotation of the first drum 211 while the leading end portion 1*b* of the continuous paper 1 is electrostatically attracted to the first drum 211. In short, the rotating force of the first drum 211 acts as a transporting force upon the continuous paper 1 in addition to the transporting force by the transport tractor 710 (refer to FIG. 12A).

Further, since the leading end portion 1*b* of the continuous paper 1 is electrostatically attracted to the first drum 211 after the leading end 1*a* of the continuous paper 1 passes the position of the first separation wedge 30, in the present embodiment, a predetermined region of the leading end portion 1*b* of the continuous paper 1 from the leading end 1*a* (region of a length equal to the distance between the first transfer charger 212*a* and the first separation wedge 30; for example, 4 to 5 cm) forms an on-charged region. Accordingly, the non-charged region is not brought into close contact with the first drum 211, and consequently, the leading end 1*a* of the continuous paper 1 can be separated away from the first drum 211 readily and is transported along the transport path without advancing to the first separation wedge 30 to cause jamming.

Furthermore, the separation voltage VP used upon automatic loading of the continuous paper 1 by the first separation charger 212*b* is set higher than the separation voltage for ordinary printing on the continuous paper 1 (the absolute values of the P-P value and the offset value described hereinabove are set comparatively high) so as to assure a good separation performance of the continuous paper 1 from the first drum 211. In particular, the leading end portion 1*b* of the continuous paper 1 is separated with certainty from the first drum 211 by a charging operation of the first separation charger 212*b* immediately after it is closely contacted with the first drum 211 by charging operation of the first transfer charger 212*a* and is acted upon by a transporting force from the first drum 211. Further, in the present embodiment, the continuous paper 1 is separated with certainty from the first drum 211 also by the first separation wedge 30.

Figure 2:
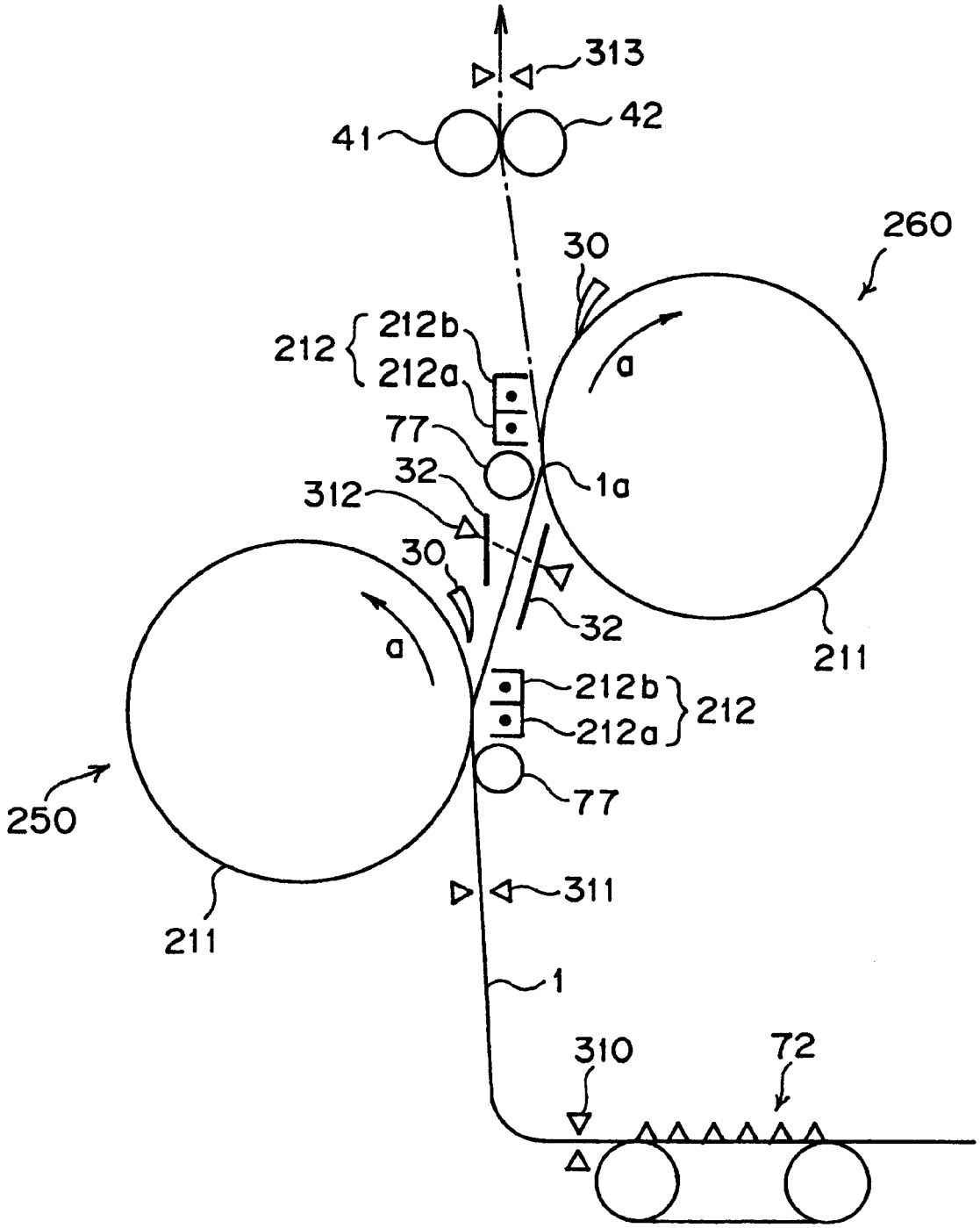

After the leading end 1*a* of the continuous paper 1 passes the first transfer process unit 250, the continuous paper 1 is acted upon by the transporting force of the transport tractor 710 and the rotational force of the first drum 211 and is transported toward the upwardly located second transfer process unit 260 as seen in FIG. 2 under the guidance of the automatic loading guide 32. Here, while it is shown in FIG. 2 that the first separation wedge 30 is shown positioned separated away from the first drum 211, according to the control timing illustrated in FIG. 12N, at this point of time, also the first separation wedge 30 still remains close to the first drum 211. However, the first separation wedge 30 may be separated away from the first drum 211 as seen in FIG. 2 immediately after the leading end 1*a* of the continuous paper 1 passes the position of the first separation wedge 30.

Then, at a point of time when the leading end 1*a* of the continuous paper 1 passes the second separation wedge 30 after the leading end 1*a* of the continuous paper 1 is detected by the sensor 312, the second contacting mechanism 230 is rendered operative to change over the positions of the second transfer unit 212 and the transfer guide roller 77 from the positions separated away from the second drum 211 to the positions close to the second drum 211, whereupon the continuous paper 1 is held between the second transfer unit 212/transfer guide roller 77 and the second drum 211 as seen in FIG. 2. Further, the transfer current VT is supplied to the second transfer charger 212*a*, and simultaneously, the separation voltage VP which is higher than the separation voltage used upon ordinary printing is applied to the second separation charger 212*b* (refer to FIGS. 12K and 12M).

Figure 3:
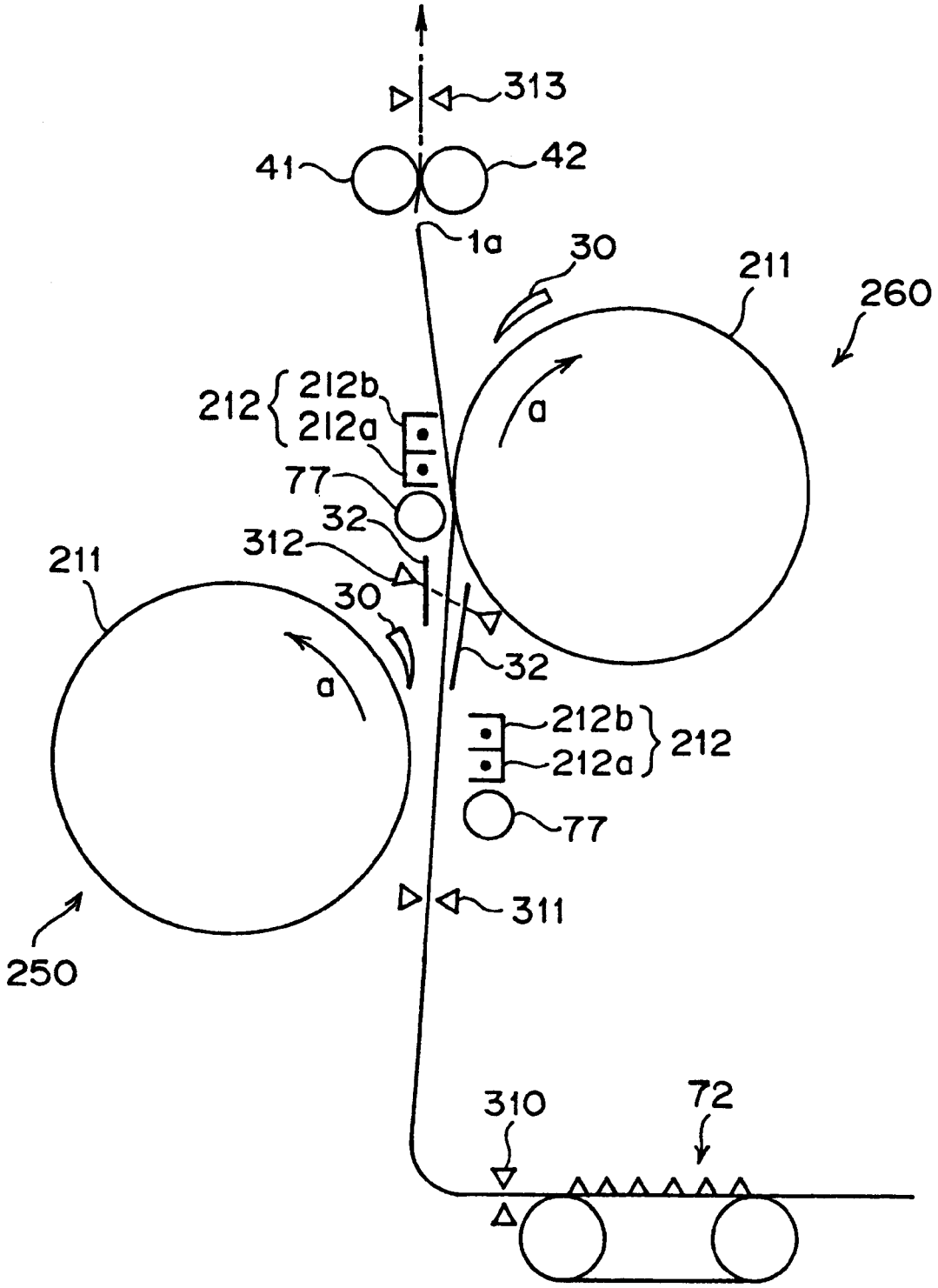

Simultaneously, the first contacting mechanism 230 is rendered operative to change over the positions of the first transfer unit 212 and the transfer guide roller 77 to the positions separated away from the first drum 211 as seen in FIG. 3. Further, the supply of the transfer current VT to the first transfer charger 212*a* is stopped and also the application of the separation voltage VP to the first separation charger 212*b* is stopped (refer to FIGS. 12J and 12L).

In this manner, the continuous paper 1 is transported to the upwardly located folding back rollers (transport rollers, medium transport means) 41 and 42 by rotation of the second drum 211 while the leading end portion 1*b* of the continuous paper 1 is electrostatically attracted to the second drum 211. In short, the rotational force of the second drum 211 acts as a transporting force upon the continuous paper 1 in addition to the transporting force by the transport tractor 710 (refer to FIG. 12A).

The restraint (transporting force) by the first drum 211 is cancelled immediately at a point of time when the continuous paper 1 becomes restrained by an electrostatic attracting force of the second drum 211, that is, at a point of time when the leading end portion 1*b* of the continuous paper 1 begins to be charged by the second transfer charger 212*a*. Consequently, the restraints of the two photosensitive drum 211 are prevented from acting upon the continuous paper 1 simultaneously.

It is to be noted that, in the present embodiment, simultaneously when the second transfer charger 212*a* and the second separation charger 212*b* are put into an on-state, also rotation of the folding back rollers (transport rollers) 41 and 42 is started.

Also in the second transfer process unit 260, the leading end portion 1*b* of the continuous paper 1 is electrostatically attracted to the second drum 211 after the leading end 1*a* of the continuous paper 1 passes the position of the second separation wedge 30 so that the predetermined region of the leading end portion 1*b* of the continuous paper 1 from the leading end 1*a* (a region of a length equal to the distance between the second transfer charger 212*a* and the second separation wedge 30; for example, 4 to 5 cm) is set as a non-charged region. Accordingly, since the non-charged region is not closely contacted with the second drum 211 at all, the leading end 1*a* of the continuous paper 1 can separated away from the second drum 211 readily and is transported along the transport path without penetrating into the separation wedge 30 to cause jamming.

Further, also in the second transfer process unit 260, the separation voltage VP used upon automatic loading of the continuous paper 1 by the second separation charger 212*b* is set higher than the separation voltage for ordinary printing on the continuous paper 1 (the absolute values of the P-P value and the offset value described above are set comparatively high) to augment the separation performance of the continuous paper 1 from the second drum 211. In particular, the leading end portion 1*b* of the continuous paper 1 is separated with certainty from the photosensitive drum 211 by a charging operation of the second separation charger 212*b* immediately after it is closely contacted with the second drum 211 by a charging operation of the transfer charger 212*a* and is acted upon by a transporting force from the second drum 211. Also by the second separation wedge 30, the continuous paper 1 is separated With certainty from the second drum 211.

Thereafter, the continuous paper 1 is transported to the upwardly located folding back rollers 41 and 42 in a condition shown in FIG. 3 until the leading end 1*a* of the continuous paper 1 passes the second transfer process unit 260 and is held between the folding back rollers 41 and 42 and then detected by the automatic loading sensor 313.

Figure 4:
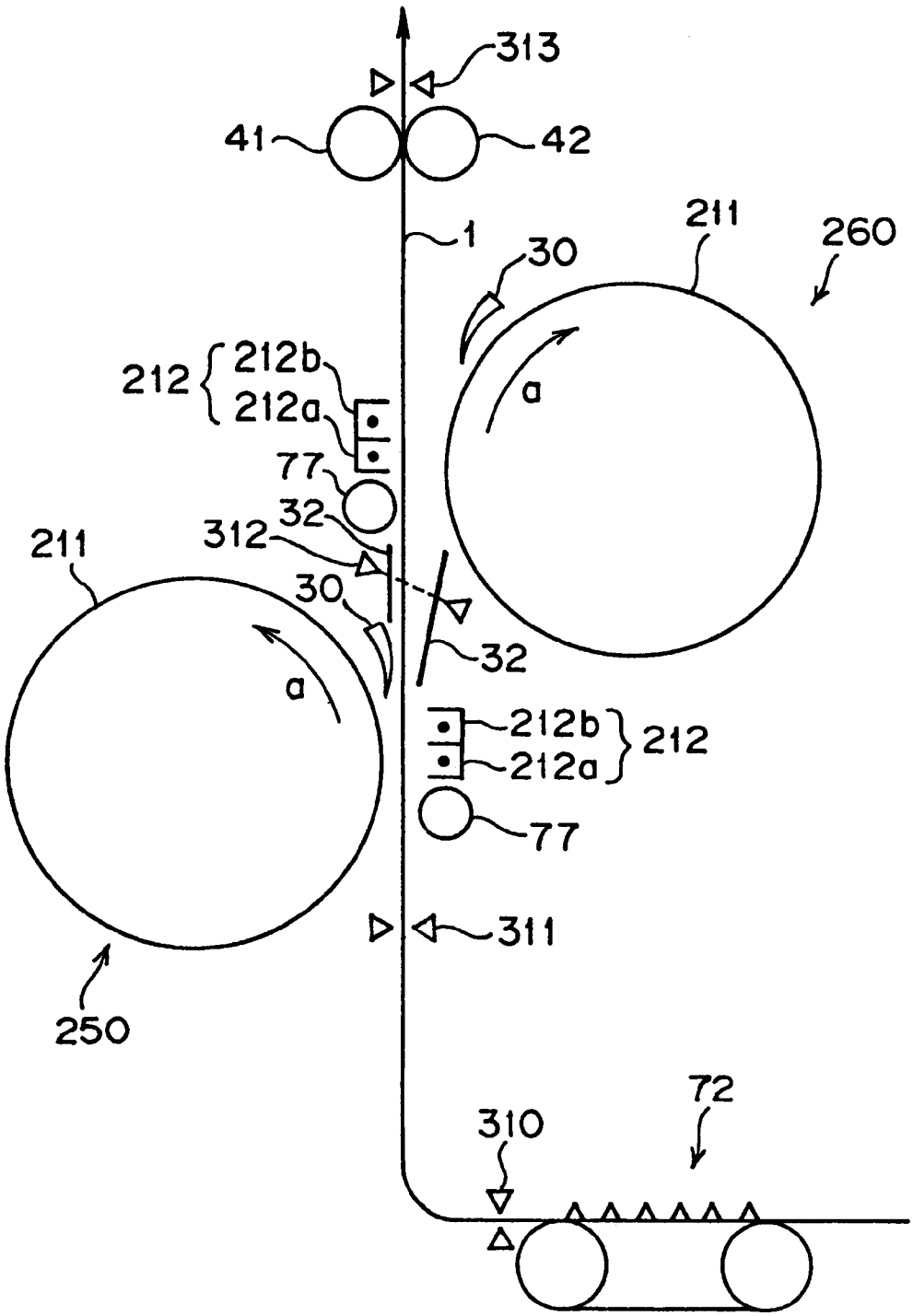

Then, as seen from FIG. 4, after the leading end 1*a* of the continuous paper 1 is detected by the automatic loading sensor 313, that is, after the leading end 1*a* of the continuous paper 1 enters a condition wherein it is held between the folding back rollers 41 and 42 and is acted upon by the transporting force from the folding back rollers 41 and 42, the second contacting mechanism 230 is rendered operative to change over the conditions of the second transfer unit 212 and the transfer guide roller 77 to the positions separated away from the second drum 211. Simultaneously, the supply of the transfer current VT to the second transfer charger 212*a* is stopped and the application of the separation voltage VP to the second separation charger 212*b* is stopped, and the application to the first precharger 215 and the second precharger 215 is stopped. Further, the separation wedge contacting mechanisms 240 are rendered operative so that the positions of the first separation wedge 30 and the second separation wedge 30 are changed over to the positions separated away from the first drum 211 and the second drum 211, respectively (refer to FIGS. 12F, 12G, 12K, 12M and 12N).

In this manner, the continuous paper 1 is transported by the transporting force of the transport tractor 710 and the transporting force by the folding back rollers 41 and 42 (refer to FIG. 12A) and is thereafter transported to the stacker 60 while it is acted upon by the transporting forces by the rollers 51, 52, 761, 762, 781, 782, 791 and 792 shown in FIG. 5.

Further, since the restraint (transporting force) by the second drum 211 is cancelled after the continuous paper 1 becomes restrained by the folding back rollers 41 and 42, the restraint of the folding back rollers 41 and 42 and the restraint of the second drum 211 are prevented from acting upon the continuous paper 1 simultaneously.

It is to be noted that the electrostatic attracting force for attracting the continuous paper 1 to each of the photosensitive drums 211 is varied in accordance with the width and/or thickness of the continuous paper 1, and also the charging efficiencies of the chargers 212*a* and 212*b* are varied by a temperature and/or a humidity which are apparatus installation environment conditions. Thus, in the present embodiment, the setting tables (refer to FIGS. 10 and 11) for the transfer current VT and the separation voltage VP are stored in advance and the chargers 212*a* and 212*b* are controlled so that the transfer current VT and the separation voltage VP may have values read out from the setting tables in accordance with the width/thickness of the continuous paper 1 inputted from the operation panel 110 (or the temperature and humidity detected by the sensors) as described above. Consequently, the continuous paper 1 can be attracted with certainty to the drums 211, and the continuous paper 1 can be separated away with certainty from the photosensitive drums 211.

Further, in the present embodiment, since the rotation conditions of the drums 211 are controlled so that, upon automatic loading of the continuous paper 1, the circumferential velocities of the drums 211 may be higher than the transport velocity of the continuous paper 1, a tension acts upon the continuous paper 1 on the upstream side with respect to each of the drums 211, and this prevents the continuous paper 1 on the upstream side from being warped with certainty.

Furthermore, in the present embodiment, at a point of time when a predetermined time T6 passes after the supply of the transfer current VT to the second transfer charger 212*a* is stopped (that is, after the application of the separation voltage VP to the second separation charger 212*b* is stopped/the application to the first precharger 215 and the second precharger 215 is stopped), the application of the bias voltage to the development units 219 is stopped ELS seen from FIGS. 12H and 12I.

In this manner, according the continuous paper printer of the present embodiment, the following advantages can be achieved.

[1] Since, upon automatic loading of the continuous paper 1, each of the photosensitive drum 211 is rotated while the continuous paper 1 is electrostatically attracted to the photosensitive drum 211 to transport the continuous paper 1 in the printing transport direction, the photosensitive drum 211 which is originally provided so as to be used to perform printing can exert a transporting force to act upon the continuous paper 1 to transport the continuous paper 1 without additional provision of a new tractor mechanism or some other transport mechanism. Accordingly, also where two transfer process units (printing process sections) are provided in a single apparatus as in the present embodiment (refer to reference numerals 250 and 260) and also where the transporting direction of the continuous paper 1 includes an upward direction, automatic loading of the continuous paper 1 can be performed with certainty without complicating the structure of the apparatus.

[2] Since, upon automatic loading of the continuous paper 1, a predetermined region of the leading end portion 1*b* of the continuous paper 1 from the leading end 1*a* is set as a non-charged region and the continuous paper 1 is charged in the region thereof following the non-charged region, the leading end 1*a* of the continuous paper 1 can be separated away from the photosensitive drum 211 readily, and the continuous paper 1 can be transported with certainty toward the downstream side of the transport path without causing penetration of the leading end 1*a* of the continuous paper 1 into the separation wedge 30 to cause jamming.

[3] Since the continuous paper 1 sent out in the printing transport direction by any of the photosensitive drums 211 can be separated away from the photosensitive drum 211 by the separation charger 212*b* and/or the separation wedge 30, the continuous paper 1 can be transported with certainty toward the downstream side of the transport path.

[4] Since the prechargers 215, transfer chargers 212*a* and separation chargers 212*b* are controlled in accordance with a printing condition such as a medium condition (the thickness or width of the continuous paper 1) or an apparatus installation environment condition (the temperature or humility), the continuous paper 1 can be attracted with certainty to the photosensitive drum 211 or can be separated away from the photosensitive drum 211 with certainty, and consequently, the continuous paper 1 can be transported with certainty toward the downstream side of the transport path.

[5] Since, upon automatic loading of the continuous paper 1, each of the photosensitive drums 211 is driven to rotate so that the circumferential velocity of the photosensitive drum 211 may be higher than the transporting velocity of the continuous paper 1, a tension acts upon the continuous paper 1 on the upstream side with respect to the photosensitive drum 211, and consequently, the continuous paper 1 on the upstream side can be prevented from being warped with certainty and the continuous paper 1 can be transported with certainty toward the downstream side of the transport path.

[6] Since the transporting force by the first drum 211 is cancelled at a point of time when the leading end portion 1*b* of the continuous paper 1 reaches the second drum 211 and is electrostatically attracted by the second drum 211, the continuous paper 1 can be prevented from being acted upon simultaneously by restraints from the two drums 211, and otherwise possible breakage of the continuous paper 1 can be prevented with certainty.

[7] Since the automatic loading guide 32 for guiding the continuous paper 1 toward above is provided between the first drum 211 and the second drum 211, the continuous paper 1 can be prevented from being bent between the drums 211 with certainty and can be transported with certainty to the second drum 211.

[8] Since the continuous paper 1 is acted upon by a transporting force by the second drum 211 until the leading end portion 1*b* of the continuous paper 1 reaches the folding back rollers 41 and 42 on the downstream side with respect to the second drum 211, the continuous paper 1 can be automatically loaded with certainty and besides the continuous paper 1 can be prevented from being acted upon by restraints simultaneously from the folding back rollers 41 and 42 and the second drum 211. Consequently, otherwise possible breakage of the continuous paper 1 can be prevented with certainty.

By the way, in the continuous paper printer of the present embodiment, the continuous paper 1 after printed is accommodated in a folded state into the stacker 60. Therefore, in order to set the continuous paper 1 in position into the tractor mechanism 73 before such automatic loading as described above is started, a position of the continuous paper 1 at which it is folded (that is, a position of a perforation) must be positioned at a correct position in accordance with a fold length of the continuous paper 1 (that is, the distance between perforations) or in accordance with a printing mode (double-sided printing mode/single-sided printing mode).

In the stacker 60, the swing guide 61 (refer to FIG. 5) is driven to rock in a period corresponding to the fold length or the printing mode inputted from the operation panel 110 or the like, and the continuous paper 1 is folded at the position of each perforation 1*c* thereof by the swing guide 61 which is driven in this manner. In this instance, if the set position of the continuous paper 1 is not correct, then the rocking timing of the swing guide 61 and the transport timing of a perforation 1*c* of the continuous paper 1 are displaced from each other and the continuous paper 1 cannot be accommodated into the stacking section 62 in a condition folded correctly at the position of each perforation 1*c*, resulting in the possibility that such a trouble as paper jamming, displacement in printing position or inappropriate stacking of the paper in the stacker may be caused. Therefore, the continuous paper 1 must be set to a correct position in accordance with a fold length or a printing mode as described above.

It is to be noted that, in the double-sided printing mode, the continuous paper 1 is transported along the path along which it contacts with both of the two photosensitive drums 211, for example, as seen in FIG. 2, but in the single-sided printing mode, the continuous paper 1 is transported along the path along which it contacts with only one of the photosensitive drums 211, for example, as seen in FIG. 1 or 3. Therefore, since the length of the transport path of the continuous paper 1 is different whether the continuous paper printer is in the double-sided printing mode or the single-sided printing mode, even if the continuous paper 1 of an equal fold length (distance between perforations) is used, the position to which the continuous paper 1 is to be set must be made different between the double-sided printing mode and the single-sided printing mode.

Figure 13:
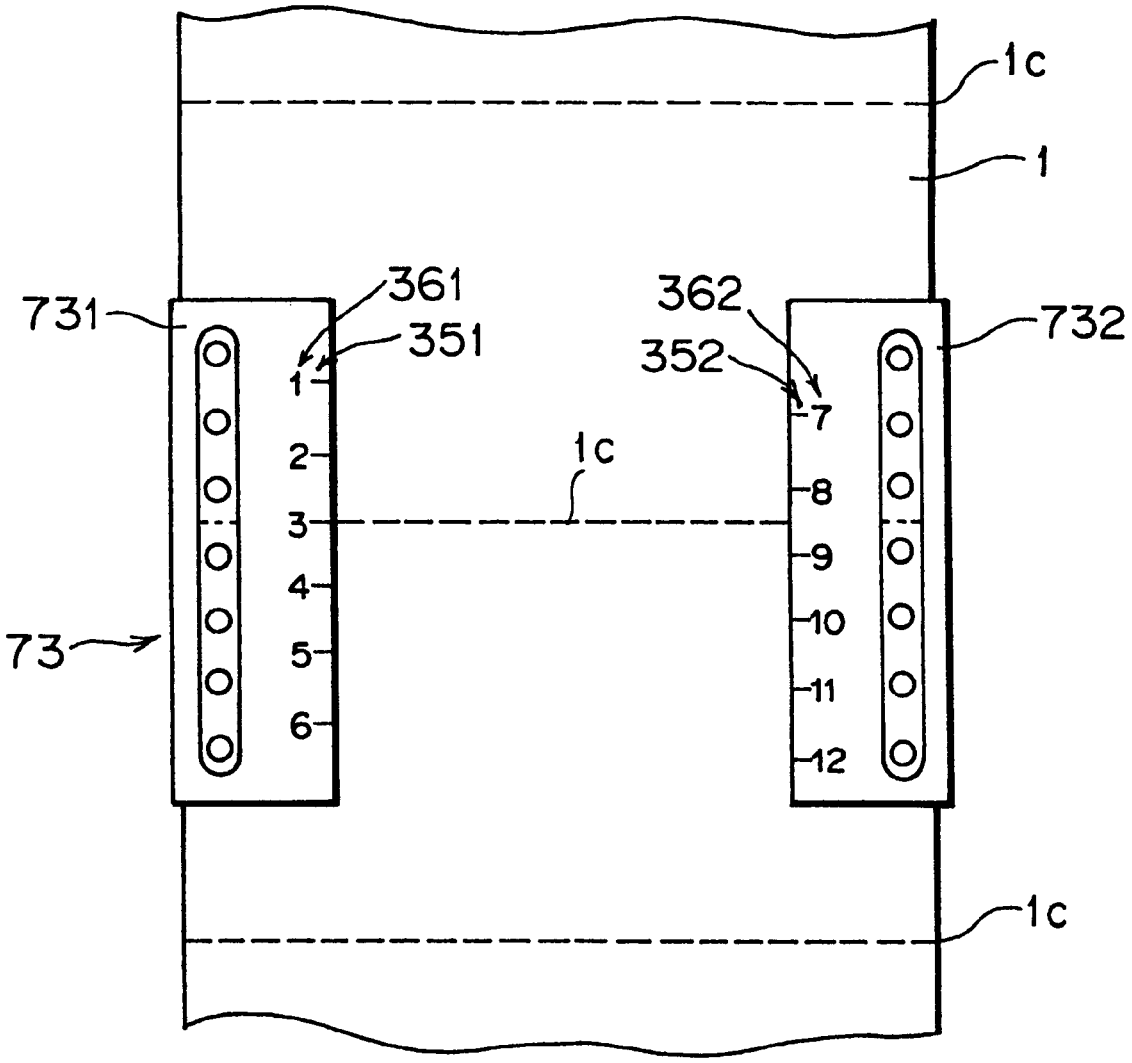
FIG. 13 is a plan view schematically showing a continuous medium mounting section (tractor mechanism/paper holder) of the continuous medium printing apparatus of FIG. 1.

In order to accurately position a perforation of the continuous paper 1, in the continuous paper printer of the present embodiment, a continuous medium mounting section (in the present embodiment, the tractor mechanism 73 on the upstream side in the transport tractor 710) to which the continuous paper 1 is to be set in position upon starting of automatic loading is constructed, for example, in such a manner as shown in FIG. 13. FIG. 13 is a plan view schematically showing the continuous medium mounting section (tractor mechanism 73/paper holder 731).

In particular, the continuous paper 1 is set to the tractor mechanism 73 with the opposite sides thereof held by the paper holders 731 and 732. The paper holders 731 and 732 have graduations (perforation position indication portions) 351 and 352 which each indicates a position to which the continuous paper 1 is to be set as an arrangement position of a perforation 1*c*, respectively.

The graduations 351 and 352 are distributed on the opposite sides in a widthwise direction of the continuous paper 1 across the continuous paper 1 and indicate different arrangement positions from each other for a perforation 1*c*. In the present embodiment, for example, the graduations 351 on the left side in FIG. 13 indicate arrangement positions for a perforation 1*c* upon single-sided printing while the gradations 352 on the right side in FIG. 13 indicate arrangement positions for a perforation 1*c* upon double-sided printing.

Further, to the six graduations 351 on the left side, the numerical letters "1" to "6" are added as identification numbers (identification information) 361, and to the six gradations 352 on the right side, the numerical letters "7" to "12" are added as identification numbers (identification information) 361.

Further, in the present embodiment, the mechanism control section 100 shown in FIG. 7 functions as a perforation position determination section for determining the arrangement position of a perforation 1*c* as an identification number 361 or 362, which specifies a graduation 351 or 352 corresponding to the arrangement position, in accordance with a printing condition for the continuous paper 1. In this instance, the printing condition is inputted by an operator from the operation panel 110 or the automatic loading operation panel 130 similarly to that described hereinabove and, for example, may be information of the distance between perforations 1*c* or printing mode information indicative of whether single-sided printing or double-sided printing should be performed for the continuous paper 1.

The mechanism control section 100 also has a display controlling function of controlling the display unit 111 of the operation panel 110 or the display unit 131 of the automatic loading operation panel 130 to display an identification number 361 or 362 determined by the function as the perforation position determination section described above.

In particular, in the present embodiment, the display unit 111 of the operation panel 110 or the display unit 131 of the automatic loading operation panel 130 functions as a perforation position indication section for indicating a mounting position of the continuous paper 1 onto the tractor mechanism 73 (paper holder 731, 732) as an arrangement position of a perforation 1*c*, or more specifically as a display section for displaying an identification number 361 or 362 which specifies a graduation 351 or 352 corresponding to an arrangement position of a perforation 1*c* determined by the mechanism control section 100. It is to be noted that a seven-segment display unit (not shown) may be provided in the proximity of the tractor mechanism 73 and used as a display section for displaying an identification number 361 or 362.

In the continuous paper printer of the present embodiment having the construction described above, when a continuous paper 1 is to be set in position to the tractor mechanism 73 before automatic loading of the continuous paper 1 is started, an operator will input and set a paper size including a distance between perforations and a printing mode (double-sided printing mode/single-sided printing mode) as printing conditions.

The mechanism control section 100 to which the printing conditions are inputted determines an arrangement position of a perforation 1*c* corresponding to the printing conditions as an identification number 361 or 362 which specifies a graduation 351 or 352 corresponding to the arrangement position, and controls the display unit 111 of the operation panel 110 or the display unit 131 of the automatic loading operation panel 130 to display the identification number 361 or 362.

Then, the operator will refer to the identification number 361 or 362 displayed on the display unit 111 or 131 and recognize the graduation 351 or 362 to which the identification number 361 or 362 is added, and then set the continuous paper 1 such that the position of the graduation 351 or 352 and the position of a perforation 1*c* may be registered with each other. For example, if the identification number determined by the mechanism control section 100 is "3", then "3" is displayed on the display unit 111 or 131, and the operator who refers to the display will set the continuous paper 1 such that the position of a perforation 1*c* may be registered with the position of the graduation 351 to which the identification number "3" is added seen in FIG. 13.

In this manner, in the continuous paper printer of the present embodiment, since the arrangement position of a perforation 1*c* is displayed as an identification number (identification symbol) on the display unit 111 or 131, even if a large number of different types are prepared for the printing mode and/or the continuous paper 1, the graduations 351 and 352 and the identification numbers 361 and 362 to be provided on the continuous medium mounting section (paper holders 731, 732) can be simplified, and a factor which causes an error in setting of a continuous paper 1 by an operator can be eliminated.

Figure 22:
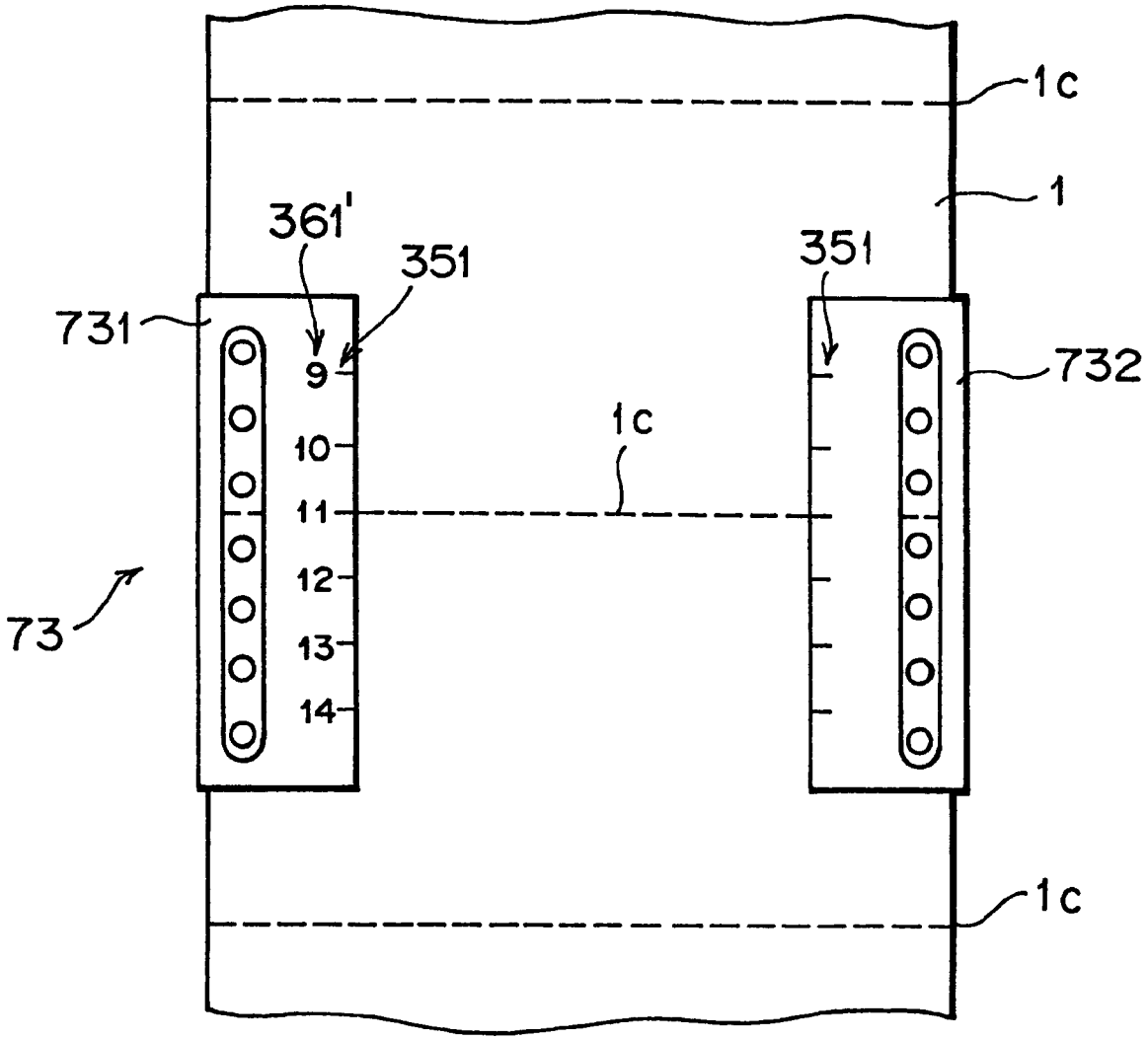
FIG. 22 RELATED ART
FIG. 22 is a plan view schematically showing a conventional continuous medium mounting section of a continuous medium printing apparatus.

Further, while, in the conventional continuous paper printer described hereinabove with reference to FIG. 22, displays of the position of a perforation to an operator are provided only in the proximity of the tractor mechanism 73 as shown in FIG. 22, in the continuous paper printer of the present embodiment, since the identification numbers 361 or 362 for specifying the arrangement position of a perforation 1*c* are displayed, in addition to such displays in the proximity of the tractor mechanism 73, on the display unit 111/131 of the operation panel 110/130 which can be visually confirmed readily by an operator, the arrangement position of a perforation 1*c* is indicated distinctly to the operator.

Further, in the continuous paper printer of the present embodiment, since the perforation display stickers for single-sided printing/double-sided printing, that is, the graduations 351/352 and the identification numbers 361/362, are distributed on the left and right sides, a display for indicating an arrangement position of a perforation 1*c* can be further simplified and a factor which causes an error in setting of the continuous paper 1 by an operator can be eliminated with a higher degree of certainty.

In this manner, even where a large number of printing modes or a large number of types of continuous media are used, upon mounting of a continuous paper 1, the arrangement position of a perforation 1*c* suitable for the printing mode or the type of the continuous paper 1 can be recognized accurately by an operator without depending upon discrimination of the operator, and occurrence of an error in setting of the continuous paper 1 can be prevented with certainty. Accordingly, also occurrence of a trouble such as paper jamming, displacement of a printing position and erroneous stacking of paper in the stacker can be prevented with certainty.

Figure 14:
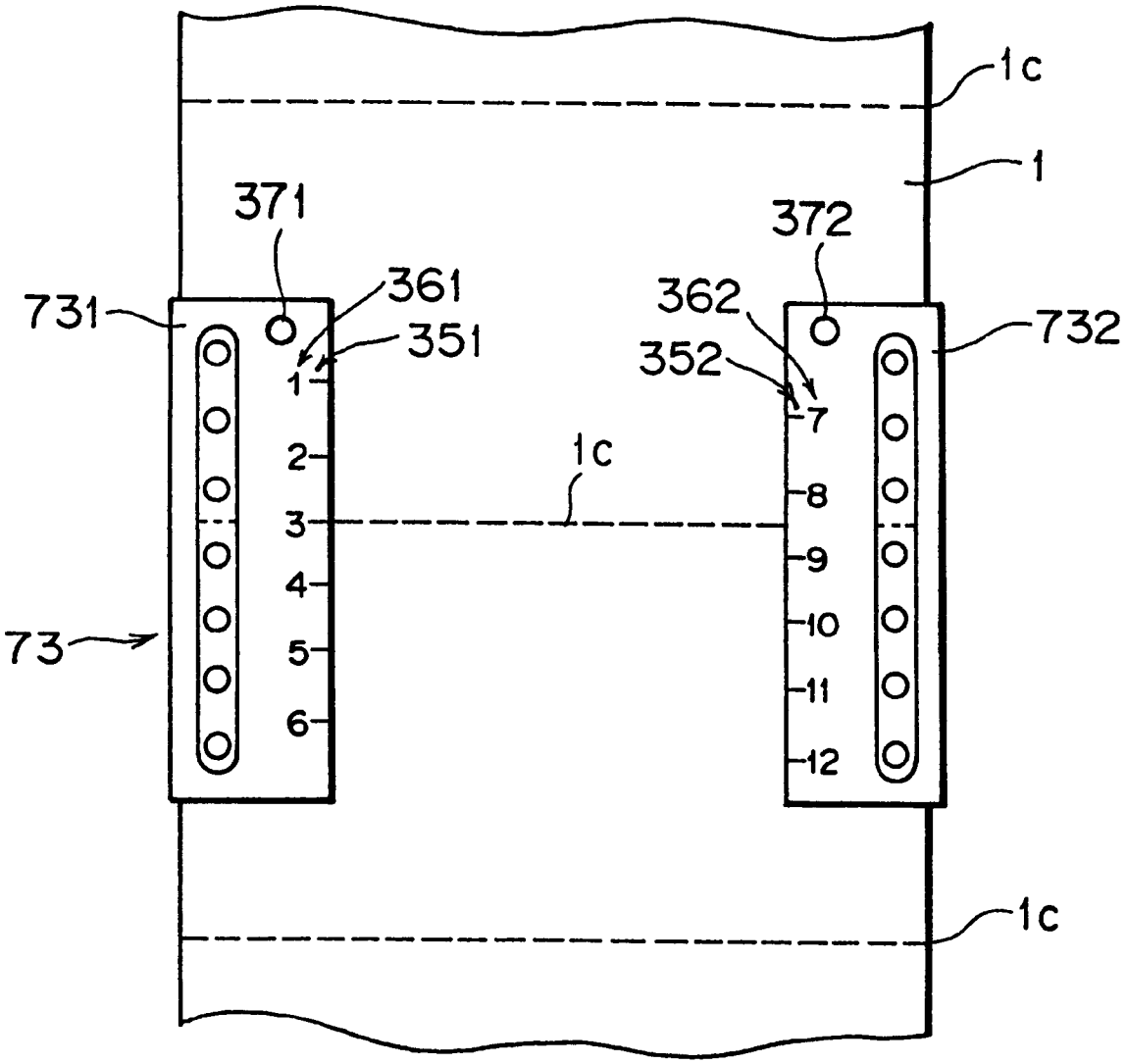
FIGS. 14 to 16 are similar views but showing different modifications to the continuous medium mounting section shown in FIG. 13.

FIG. 14 schematically shows a first modification to the continuous medium mounting section (tractor mechanism/paper holder) of the continuous paper printer of the present embodiment. Referring to FIG. 14, the modified continuous medium mounting section includes, in addition to the components shown in FIG. 13, a pair of LEDs (light emitting devices) 371 and 372 provided on the left and right paper holders 731 and 732, respectively. The LEDs 371 and 372 are provided to indicate which ones of the left and right graduations 351 and 352 (identification numbers 361 and 362) are valid for indication.

Thus, one of the LEDs 371 and 372 on the side on which a graduation 351 or 352 which indicates the arrangement position of a perforation 1*c* determined by the mechanism control section 100 is present is driven to be lit.

Accordingly, in the first modification described above, since, upon single-sided printing, an indication by a graduation 351 on the left side is valid, the left side LED 371 is driven to be lit, but upon double-sided printing, since an indication by a gradation 352 on the right side is valid, the right side LED 372 is driven to be lit.

With the first modification having the construction described above, similar advantages to those described hereinabove with reference to FIG. 13 can be achieved. Besides, which one of indications of the left and right graduations 351 and 352 should be adopted is displayed distinctly to the operator, and consequently, occurrence of an error in setting of the continuous paper 1 by the operator can be prevented with certainty.

Figure 15:
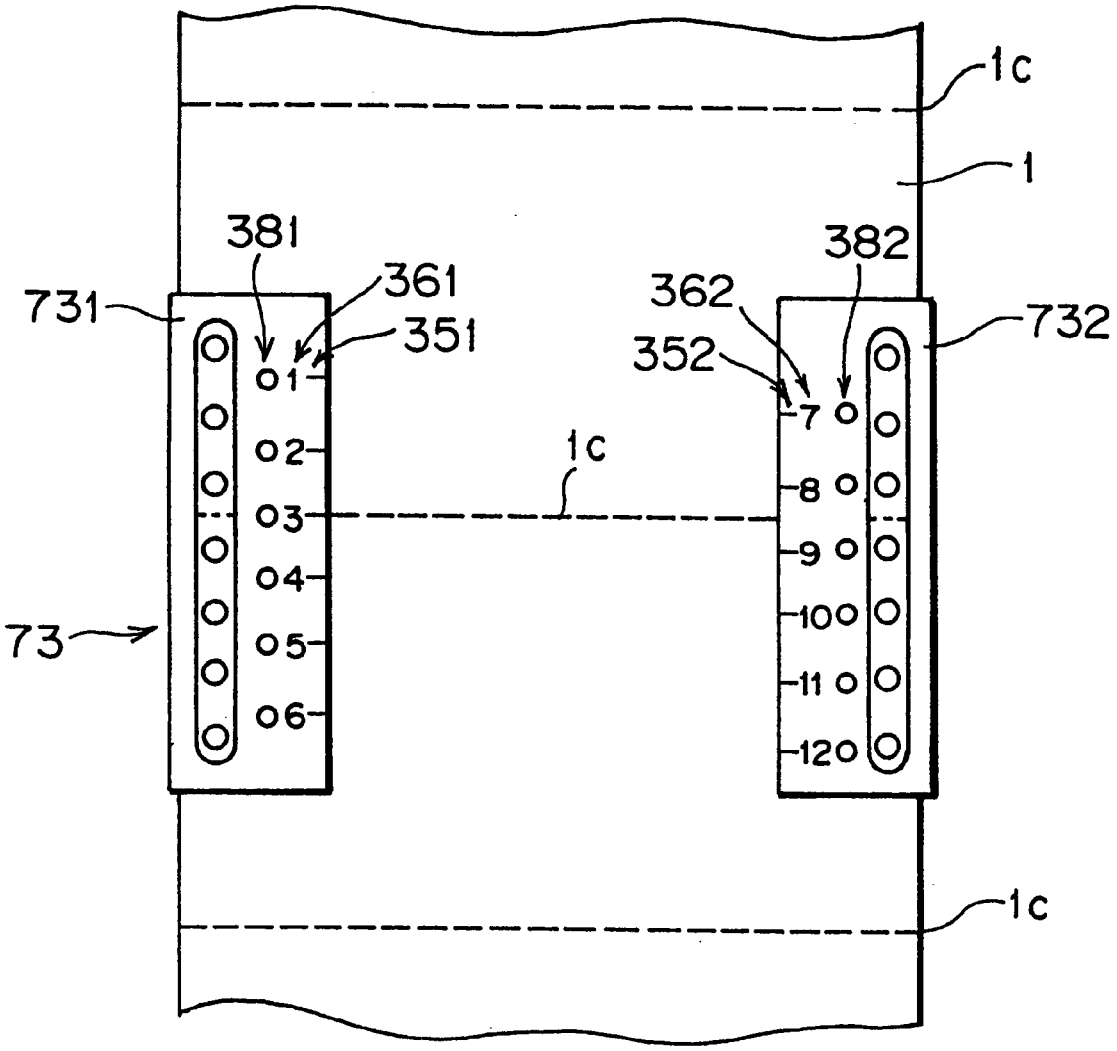

FIG. 15 schematically shows a second modification to the continuous medium mounting section (tractor mechanism/paper holder) of the continuous paper printer of the embodiment described above. Referring to FIG. 15, the present modified continuous mounting section includes, in addition to the components shown in FIG. 13, a plurality of LEDs 381 and 382 provided in a juxtaposed relationship with the graduations 351 and 352 (identification numbers 361 and 362) for indicating an arrangement position of a perforation 1*c*, respectively.

Thus, only that one of the LEDs 381 and 382 which is juxtaposed with a graduation 351 or 352 which indicates the arrangement position of a perforation 1*c* determined by the mechanism control section 100 is driven to be lit.

Accordingly, with the second modification, similar advantages to those described hereinabove with reference to FIG. 13 can be achieved. Besides, since only that one of the LEDs 381 and 382 which is juxtaposed with a specific graduation 351 or 352 to which a perforation 1*c* should be arranged is lit, attention of the operator is paid to the specific graduation 351 or 352. Consequently, occurrence of an error in setting of the continuous paper 1 by the operator can be prevented with a higher degree of certainty.

It is to be noted that, in the second modification described above, the graduations 351 and 352 and the LEDs 381 and 382 may not be provided in a juxtaposed relationship with each other, but alternatively, the arrangement position of a perforation 1*c* may be indicated directly by one of the LEDs 381 and 382. Also with the alternative arrangement, similar advantages to those described above can be achieved.

Figure 16:
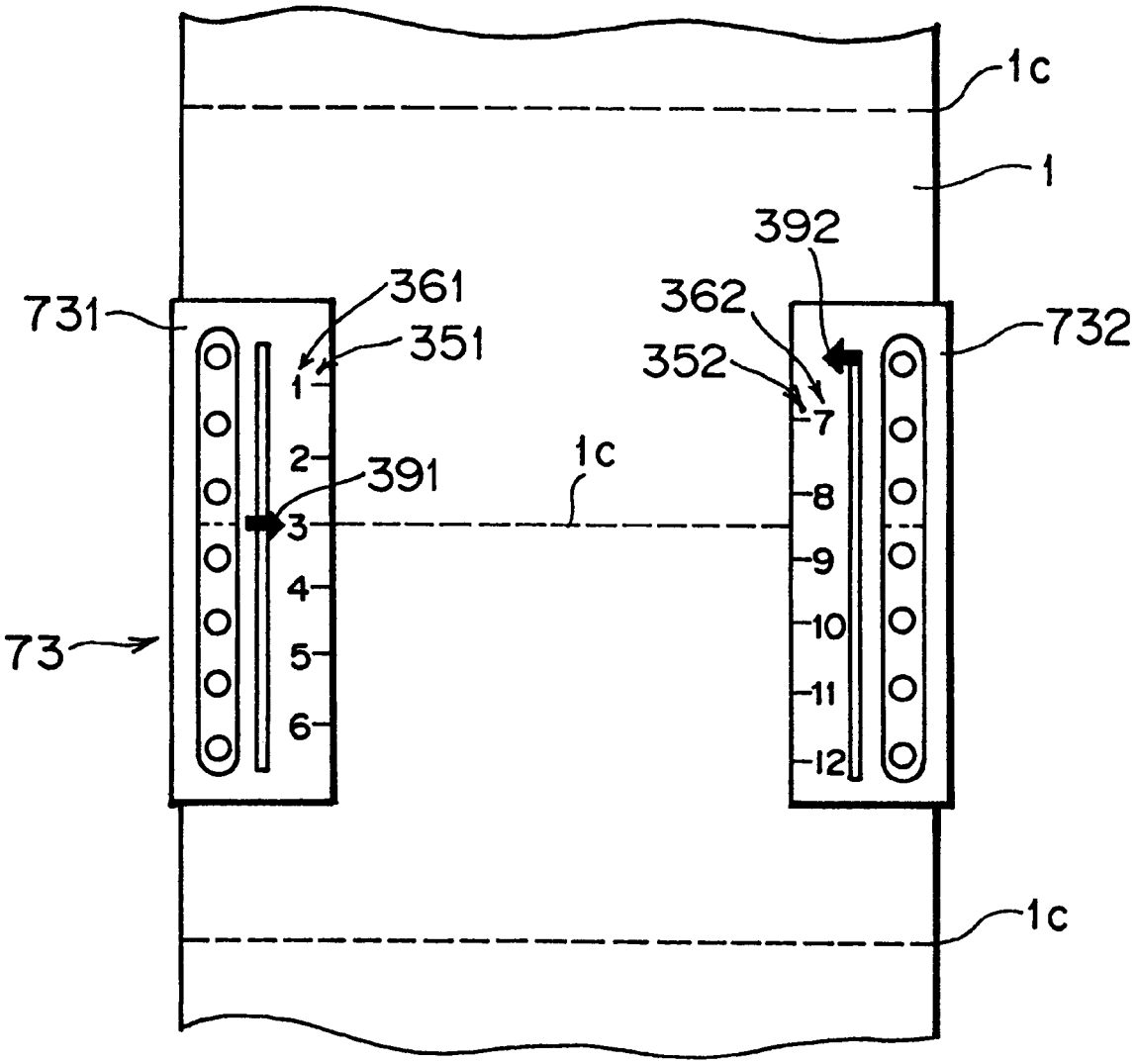

FIG. 16 schematically shows a further modification to the continuous medium mounting section (tractor mechanism/paper holder) of the continuous paper printer of the embodiment described above. Referring to FIG. 16, the third modification includes, in addition to the components described hereinabove with reference to FIG. 13, a pair of movable pointers (movable indication members) 391 and 392 provided in a juxtaposed relationship with the graduations 351 and 352 (identification numbers 361, 362) for indicating the arrangement position of a perforation 1*c*, respectively.

Thus, the movable pointer 391 or 392 is driven to be positioned to the position of a graduation 351 or 352 which indicates the arrangement position of a perforation 1*c* determined by the mechanism control section 100. It is to be noted that that one of the movable pointers 391 and 392 whose indication is invalid is driven to be positioned to a position other than a predetermined region for indicating the arrangement position of a perforation 1*c*. For example, if the identification number determined by the mechanism control section 100 is "3", then the left side movable pointer 391 is positioned to the position of a graduation 351 to which the identification number "3" is added while the right side movable pointer 392 is positioned to a position at which it indicates none of the graduations 352.

Accordingly, also with the third modification, similar advantages to those described hereinabove with reference to FIG. 13 are achieved. Further, since a specific graduation 351 or 352 to which a perforation 1*c* should be positioned is indicated by the movable pointer 391 or 392, attention of the operator is paid to the specific graduation 351 or 352, and occurrence of an error in setting of the continuous paper 1 by the operator can be prevented with a higher degree of certainty.

It is to be noted that the third modification described above may be further modified such that the graduations 351 and 352 and the movable pointers 391 and 392 are not provided in a juxtaposed relationship with each other but the arrangement position of a perforation 1*c* is indicated directly by each of the movable pointers 391 and 392. Also in this instance, similar advantages to those described above can be achieved.

Finally, the shapes of the pinch rollers 52, 712, 762, 782 and 792 used in the continuous paper printer of the present embodiment are described with reference to FIGS. 17 to 21.

Figure 17:
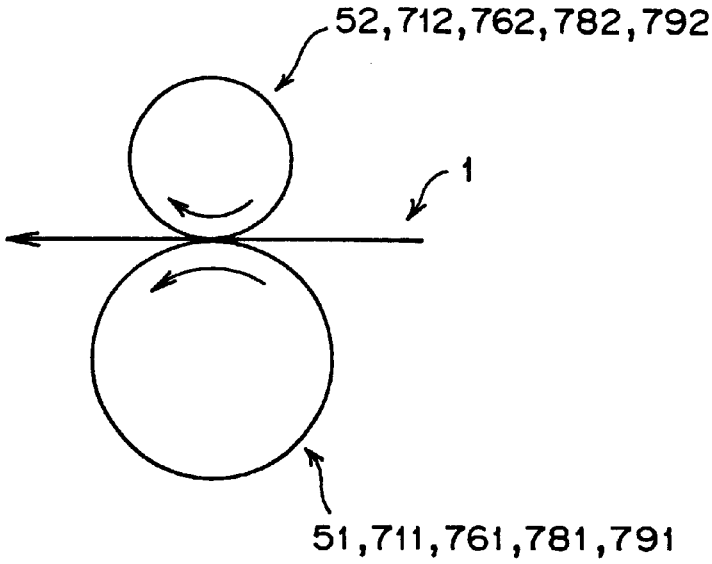
FIG. 17 is a side elevational view schematically showing a structure of a portion of the continuous medium printing apparatus of FIG. 1 in which a pinch roller is provided.

Referring first to FIGS. 17' and 18, the pinch rollers 52, 712, 762, 782 and 792 are disposed in an opposing relationship to the rollers 51, 711, 761, 781 and 791, which are each acted upon and rotated by a rotating driving force, across the continuous paper 1.

Figure 18:
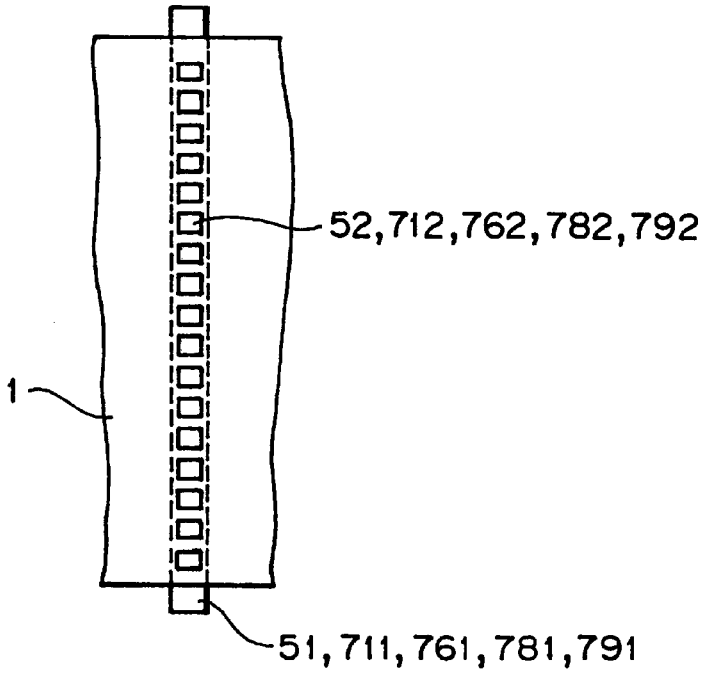
FIG. 18 is a plan view schematically showing the structure of the portion of the continuous medium printing apparatus shown in FIG. 17.

Each of the pinch rollers 52, 712, 762, 782 and 792 includes a plurality of roller elements arranged in an axial direction thereof as seen in FIG. 18. It is to be noted that, in the following description, each of the roller elements of each of the pinch rollers 52, 712, 762, 782 and 792 is denoted by the same reference numeral as that which denotes the pinch roller 52, 712, 762, 782 or 792, respectively, and is referred to similarly as pinch roller for convenience of description.

Each of the pinch rollers 52, 712, 762, 782 and 792 has an independently suspended structure and presses down the continuous paper 1 against the roller 51, 711, 761, 781 or 791 while it is rotated by the continuous paper 1 as the continuous paper 1 is transported.

By the way, as seen from FICr. 21, a conventional pinch roller 52', 712', 762', 782' or 792' has such a chamfered or rounded cylindrical shape wherein it has a rounded profile of 0.1 to 0.5 mm in radius provided at a circumferential edge of each end face thereof for convenience of working.

However, where a pinch roller has such a rounded cylindrical shape as described above, if an end face of the pinch roller 52', 712', 762', 782' or 792' and a side end face 1*d* of the continuous paper 1 come in register with each other, then there is the possibility that, when the continuous paper 1 is advanced/retracted, the side end face 1*d* of the continuous paper 1 may be moved by approximately 1 mm in a direction different by 90 degrees from the transporting direction and the side end face 1*d* of the continuous paper 1 may ride on the end face of the pinch roller 52', 712', 762', 782' or 792', by which the transportation of the continuous paper 1 is disturbed. Usually, the position in the widthwise direction of the continuous paper 1 loaded in the electrophotographic printer apparatus is selected arbitrarily by a user and cannot be specified (also the position of the pitch roller cannot be specified).

Figures 19A, 19B:
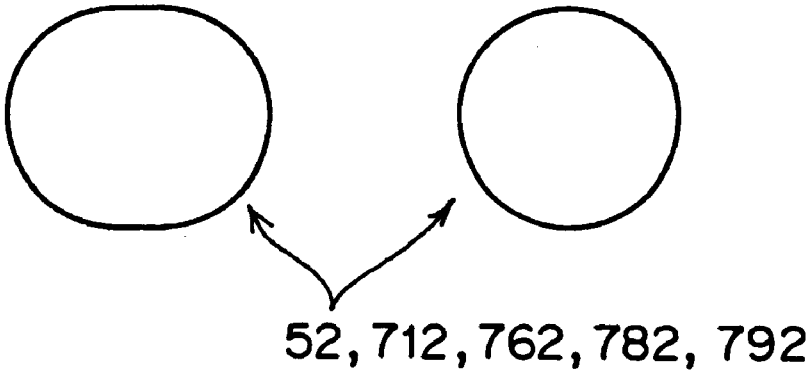
FIGS. 19A and 19B are a front elevational view and a side elevational view, respectively, showing a pinch roller of the continuous medium printing apparatus of FIG. 1.
Figures 20A, 20B:
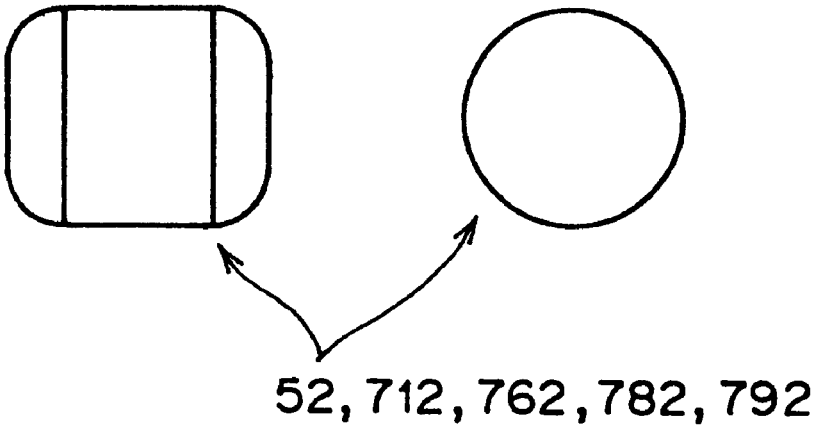
FIGS. 20A and 20B are a front elevational view and a side elevational view, respectively, showing a modification to the pinch roller shown in FIGS. 19A and 19B.
Figure 21:
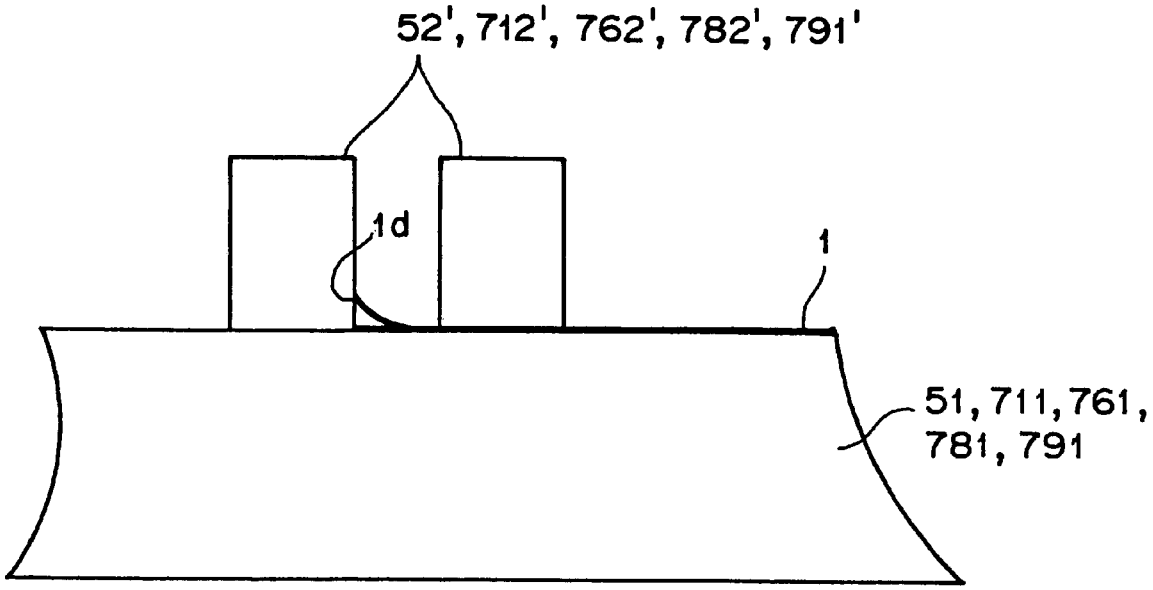
FIG. 21 PRIOR ART
FIG. 21 is a schematic view illustrating a subject to be solved which is provided by a shape of a conventional pinch roller.

Thus, each of the pinch rollers 52, 712, 762, 782 and 792 in the continuous paper printer of the present embodiment is so shaped that it has an end face having such an elliptical shape as shown in FIGS. 19A and 19B or such a rounded shape with a greater radius than ever as shown in FIGS. 20A and 20B. Consequently, even if the continuous paper 1 moves, a side end face 1*d* of the continuous paper 1 will not ride on an end face of the pinch roller 52, 712, 862, 782 or 792, and the continuous paper 1 can be transported with certainty.

It is to be noted that the present invention is not limited to the embodiment specifically described above, and variations and modifications can be made without departing from the scope of the present invention.

For example, while, in the embodiment described above, the present invention is applied to a double-sided printing apparatus which includes two transfer process units, the present invention is not limited to this and can be applied also to a single-sided printing apparatus which includes a single transfer process unit and a printing apparatus which includes three or more transfer process units in a similar manner as described above. Also in this instance, similar advantages to those of the embodiment described above can be achieved.

What is claimed is:

1. A continuous medium printing apparatus for printing on a continuous medium on which a plurality of folding perforations are formed in a separated relationship by a fixed distance from each other, comprising:

a continuous medium mounting section onto which the continuous medium is to be mounted when automatic loading of the continuous medium into said continuous medium printing apparatus is to be started;

a perforation position indication section for indicating a position of said continuous medium mounting section at which the continuous medium is to be mounted as an arrangement position of any of the perforations; and a perforation position determination section for determining an arrangement position of any of the perforations to be indicated by said perforation position indication section in accordance with a printing condition for the continuous medium.

2. A continuous medium printing apparatus as claimed in claim 1, wherein said perforation position indication section includes:

a plurality of graduations provided in the proximity of said continuous medium mounting section for directly indicating an arrangement position of any of the perforations and having identification information added thereto; and a display section for displaying the identification information of one of the graduations which corresponds to the arrangement position of any of the perforations determined by said perforation position determination section.

3. A continuous medium printing apparatus as claimed in claim 2, wherein a display unit of an operation panel of said continuous medium printing apparatus is used as said display section.

4. A continuous medium printing apparatus as claimed in claim 2, wherein a seven-segment display unit provided in the proximity of said continuous medium mounting section is used as said display section.

5. A continuous medium printing apparatus as claimed in claim 2, wherein a display unit of an operation panel provided for exclusive use for operating automatic loading of the continuous medium is used as said display section.

6. A continuous medium printing apparatus as claimed in claim 2, wherein said graduations are distributed on said continuous medium mounting section on the opposite sides in a widthwise direction of the continuous medium across the continuous medium, and said graduations on the opposite sides in the widthwise direction of the continuous medium indicate different arrangement positions for any of the perforations from each other.

7. A continuous medium printing apparatus as claimed in claim 6, wherein those of said graduations on one side indicate arrangement positions for any one of the perforations upon single-sided printing and those of said graduations on the other side indicate arrangement positions for any of the perforations upon double-sided printing.

8. A continuous medium printing apparatus as claimed in claim 6, further comprising a pair of light emitting elements provided on the opposite sides in the widthwise direction of the continuous medium for indicating whether an indication by one of those of said graduations on one of the opposite sides in the widthwise direction of the continuous medium or an indication by one of those of said graduations on the other of the opposite sides in the widthwise direction of the continuous medium is valid, and wherein one of said light emitting elements which is on that side of one of said graduations which is determined to indicate an arrangement position of any of the perforations by said perforation position determination section is driven to be lit.

9. A continuous medium printing apparatus as claimed in claim 7, further comprising a pair of light emitting elements provided on the opposite sides in the widthwise direction of the continuous medium for indicating whether an indication by one of those of said graduations on one of the opposite sides in the widthwise direction of the continuous medium or an indication by one of those of said graduations on the other of the opposite sides in the widthwise direction of the continuous medium is valid, and wherein one of said light emitting elements which is on that side of one of said graduations which is determined to indicate an arrangement position of any of the perforations by said perforation position determination section is driven to be lit.

10. A continuous medium printing apparatus as claimed in claim 1, wherein said perforation position indication section includes a plurality of light emitting elements provided in the proximity of said continuous medium mounting section for indicating an arrangement position of any of the perforations, and one of said light emitting elements which is disposed at an arrangement position of one of the perforations determined by said perforation position determination section is driven to be lit.

11. A continuous medium printing apparatus as claimed in claim 10, wherein said plurality of light emitting elements are distributed on the opposite sides in a widthwise direction of the continuous medium across the continuous medium on said continuous medium mounting section, and said light emitting elements on the opposite sides in the widthwise direction of the continuous medium indicate different arrangement positions for any of the perforations from each other.

12. A continuous medium printing apparatus as claimed in claim 11, wherein those of said light emitting elements on one side indicate arrangement positions for any of the perforations upon single-sided printing and those of said light emitting elements on the other side indicate arrangement positions for any of the perforations upon double-sided printing.

13. A continuous medium printing apparatus as claimed in claim 1, wherein said perforation position indication section includes a movable indication member provided in the proximity of said continuous medium mounting section for indicating an arrangement position of any of the perforations, and said movable indication member is driven to be positioned at an arrangement position of any of the perforations determined by said perforation position determination section.

14. A continuous medium printing apparatus as claimed in claim 13, wherein said movable indication members are provided on the opposite sides in a widthwise direction of the continuous medium across the continuous medium on the continuous medium mounting section, and said movable indication members on the opposite sides in the widthwise direction of the continuous medium indicate arrangement positions for any of the perforations which are different from each other.

15. A continuous medium printing apparatus as claimed in claim 14, wherein one of said movable indication members on one side indicates an arrangement position of any of the perforations upon single-sided printing and the other of said movable indication members on the other side indicates an arrangement position of any of the perforations upon double-sided printing.

16. A continuous medium printing apparatus as claimed in claim 14, wherein one of said movable indication members which is on one of the opposite sides in the widthwise direction of the continuous medium on which an indication is invalid is driven to be positioned at a position outside a predetermined range for indicating an arrangement position of any of the perforations.

17. A continuous medium printing apparatus as claimed in claim 15, wherein one of said movable indication members which is on one of the opposite sides in the widthwise direction of the continuous medium on which an indication is invalid is driven to be positioned at a position outside a predetermined range for indicating an arrangement position of any of the perforations.

18. A continuous medium printing apparatus as claimed in claim 1, further comprising a printing condition inputting section for inputting the printing condition to said perforation position determination section.

19. A continuous medium printing apparatus as claimed in claim 1, wherein the printing condition is information regarding the fixed distance between the perforations formed in the continuous medium.

20. A continuous medium printing apparatus as claimed in claim 1, wherein the printing condition is information regarding a printing operation for the continuous medium.

21. A continuous medium printing apparatus as claimed in claim 20, wherein the information regarding a printing operation is printing mode information which indicates whether single-sided printing should be performed or double-side printing should be performed for the continuous medium.

* * * * *